US008506189B2

(12) United States Patent
Sekino et al.

(10) Patent No.: US 8,506,189 B2
(45) Date of Patent: Aug. 13, 2013

(54) PRINTING APPARATUS INCLUDING PLURAL PRINTHEADS AND A DRIVE MECHANISM FOR THE PLATEN ROLLERS

(75) Inventors: Toshiharu Sekino, Izu (JP); Kenji Eoka, Sunto-gun (JP); Kiyotaka Nihashi, Mishima (JP); Takeshi Hiyoshi, Mishima (JP); Tsuyoshi Sanada, Ang Mo Kio (SG); Akira Suzuki, Ang Mo Kio (SG)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 141 days.

(21) Appl. No.: 12/898,073

(22) Filed: Oct. 5, 2010

(65) Prior Publication Data

US 2011/0018957 A1 Jan. 27, 2011

Related U.S. Application Data

(62) Division of application No. 11/681,916, filed on Mar. 5, 2007, now Pat. No. 7,891,893.

(30) Foreign Application Priority Data

| | | |
|---|---|---|
| Jun. 29, 2006 | (JP) | 2006-178941 |
| Jun. 29, 2006 | (JP) | 2006-178942 |
| Jun. 29, 2006 | (JP) | 2006-178943 |
| Jun. 29, 2006 | (JP) | 2006-178949 |
| Jun. 29, 2006 | (JP) | 2006-178950 |
| Jun. 29, 2006 | (JP) | 2006-178952 |
| Jun. 29, 2006 | (JP) | 2006-178954 |
| Jun. 29, 2006 | (JP) | 2006-178955 |

(51) Int. Cl.
*B41J 3/60* (2006.01)

(52) U.S. Cl.
USPC ..... 400/188; 400/149; 347/218

(58) Field of Classification Search
USPC ..... 400/188, 149; 347/218–220
IPC ..... B41J 3/54, 3/60
See application file for complete search history.

(56) References Cited

U.S. PATENT DOCUMENTS 5,038,155 A 8/1991 Yamagishi et al.
5,172,989 A * 12/1992 Imaseki et al. ..... 400/641

(Continued)

FOREIGN PATENT DOCUMENTS

CN 1079735 C 2/2002
EP 59068275 4/1984

(Continued)

OTHER PUBLICATIONS

Japanese Office Action for 2006-178941 mailed on Aug. 3, 2010.

(Continued)

*Primary Examiner* — Leslie J Evanisko
(74) *Attorney, Agent, or Firm* — Turocy & Watson, LLP

(57) ABSTRACT

A thermal printer includes a first thermal head, a first platen roller, first biasing means, a second thermal head, a second platen roller, and second biasing means. The first thermal head, the first platen roller, the first biasing means are in contact with a heat-sensitive layer of thermal recording paper. The second thermal head, the second platen roller, and the second biasing means are in contact with a heat-sensitive layer of the thermal recording paper. The second thermal head is arranged on the upstream side of the first thermal head in a paper feed direction. A paper feed speed of the first platen roller to the thermal recording paper is larger than a paper feed speed of the second platen roller. The first platen roller is in contact with the thermal recording paper while being more slippery compared with the second platen roller.

2 Claims, 26 Drawing Sheets

(56) References Cited

U.S. PATENT DOCUMENTS

| | | | |
|---|---|---|---|
| 5,206,662 | A | 4/1993 | Fox et al. |
| 5,668,585 | A | 9/1997 | Brechko et al. |
| 5,724,085 | A | 3/1998 | Inui et al. |
| 6,068,419 | A | 5/2000 | Shiozaki et al. |
| 6,118,469 | A | 9/2000 | Hosomi |
| 6,759,366 | B2 | 7/2004 | Beckerdite et al. |
| 6,784,906 | B2 | 8/2004 | Long et al. |
| 7,710,442 | B2 | 5/2010 | Lyons et al. |
| 8,013,885 | B2 | 9/2011 | Kohira et al. |
| 2001/0019352 | A1 | 9/2001 | Miyazaki et al. |
| 2002/0158962 | A1 | 10/2002 | Ishikawa et al. |
| 2004/0135872 | A1 | 7/2004 | Burdenko |
| 2004/0189783 | A1 | 9/2004 | Mogi et al. |
| 2005/0180796 | A1 | 8/2005 | Blanchard et al. |

FOREIGN PATENT DOCUMENTS

| | | | | |
|---|---|---|---|---|
| EP | 947340 | A2 | * | 10/1999 |
| JP | 58-008668 | | | 1/1983 |
| JP | 58-51172 | | | 3/1983 |
| JP | 59068273 | A | | 4/1984 |
| JP | 61-003765 | | | 1/1986 |
| JP | 61-068270 | | | 4/1986 |
| JP | 63-77795 | | | 4/1988 |
| JP | 01-157869 | | | 6/1989 |
| JP | 1-108743 | | | 7/1989 |
| JP | 3030981 | A | | 2/1991 |
| JP | 03-051149 | | | 3/1991 |
| JP | 3-53955 | | | 3/1991 |
| JP | 04-17952 | | | 2/1992 |
| JP | 04-156363 | | | 5/1992 |
| JP | 05096768 | A | * | 4/1993 |
| JP | 06-024082 | | | 2/1994 |
| JP | 06-39444 | | | 5/1994 |
| JP | 07-009718 | | | 1/1995 |
| JP | 07025094 | A | | 1/1995 |
| JP | 07-27852 | | | 5/1995 |
| JP | 07-195795 | | | 8/1995 |
| JP | 09-233256 | | | 9/1997 |
| JP | 10-006595 | | | 1/1998 |
| JP | 10-016324 | | | 1/1998 |
| JP | 10-076713 | | | 3/1998 |
| JP | 10-338378 | | | 12/1998 |
| JP | 11-286147 | | | 10/1999 |
| JP | 2000-034043 | | | 2/2000 |
| JP | 2000168188 | A | | 6/2000 |
| JP | 2000-335033 | | | 12/2000 |
| JP | 2001-071569 | | | 3/2001 |
| JP | 2001-199095 | | | 7/2001 |
| JP | 2001-232876 | | | 8/2001 |
| JP | 2002086820 | A | | 3/2002 |
| JP | 2003-136796 | | | 5/2003 |
| JP | 2004167970 | A | | 6/2004 |
| JP | 2005-001151 | | | 1/2005 |
| JP | 2005-132550 | | | 5/2005 |
| JP | 2006-051734 | | | 2/2006 |

OTHER PUBLICATIONS

European Search Report for EP 07 10 9277 mailed on Oct. 5, 2007.
Japanese Office Action mailed on Apr. 4, 2008 corresponding to U.S. Appl. No. 11/681,916, filed Mar. 5, 2007.
Japanese Office Action mailed on May 7, 2008 corresponding to U.S. Appl. No. 11/681,916, filed Mar. 5, 2007.
Japanese Office Action mailed on May 9, 2008 corresponding to U.S. Appl. No. 11/681,916, filed Mar. 5, 2007.
Japanese Office Action mailed on Apr. 23, 2008 corresponding to U.S. Appl. No. 11/681,916, filed Mar. 5, 2007.
Japanese Office Action mailed on Jun. 26, 2008 corresponding to U.S. Appl. No. 11/681,916, filed Mar. 5, 2007.
Japanese Office Action mailed on Jul. 3, 2008 corresponding to U.S. Appl. No. 11/681,916, filed Mar. 5, 2007.
Japanese Office Action mailed on Jan. 6, 2009 corresponding to U.S. Appl. No. 11/681,916, filed Mar. 5, 2007.
Chinese Office Action for 200710111493.6 mailed on Oct. 16, 2009.
Office Action for U.S. Appl. No. 11/681,916 mailed on Apr. 1, 2010.
Japanese Office Action for 2008-19507 mailed on Dec. 15, 2009.
OA dated Dec. 13, 2012 for U.S. Appl. No. 12/898,066, 17 pages.
OA dated Dec. 7, 2012 for U.S. Appl. No. 12/898,071, 16 pages.
OA dated Dec. 12, 2012 for U.S. Appl. No. 12/898,078, 16 pages.
OA dated Dec. 6, 2012 for U.S. Appl. No. 12/898,081, 19 pages.
OA dated Oct. 12, 2011 for U.S. Appl. No. 12/898,066, 53 pages.
OA dated Mar. 22, 2012 for U.S. Appl. No. 12/898,066, 19 pages.
OA dated Oct. 7, 2011 for U.S. Appl. No. 12/898,071, 30 pages.
OA dated Mar. 21, 2012 for U.S. Appl. No. 12/898,071, 11 pages.
OA dated Oct. 7, 2011 for U.S. Appl. No. 12/898,076, 40 pages.
OA dated Mar. 29, 2012 for U.S. Appl. No. 12/898,076, 11 pages.
OA dated Oct. 7, 2011 for U.S. Appl. No. 12/898,078, 46 pages.
OA dated Mar. 21, 2012 for U.S. Appl. No. 12/898,078, 19 pages.
OA dated Oct. 7, 2011 for U.S. Appl. No. 12/898,081, 45 pages.
OA dated Mar. 29, 2012 for U.S. Appl. No. 12/898,081, 14 pages.
OA dated Oct. 12, 2011 for U.S. Appl. No. 12/898,085, 38 pages.
OA dated Mar. 30, 2012 for U.S. Appl. No. 12/898,085, 18 pages.
Office Action dated Mar. 28, 2013 for U.S. Appl. No. 12/898,081, 15 pages.
Office Action dated Mar. 29, 2013 for U.S. Appl. No. 12/898,085, 23 pages.

* cited by examiner 810
811
820
821
822
823
824
825
826
827
828
829
830
831
832
833
834
835
836
837
838
839
840
841
842
843
850
851
852
853
854
855
856
857
858
859
860
861
862
863
864
865

| | G1 | G2 | G3 | G4 | G5 | G6 | | G7 | G8 |
|---|---|---|---|---|---|---|---|---|---|
| | Normal rotation conveyance | Reversal rotation conveyance | Printing by second printing unit | Printing by first printing unit | Cutting | Reversal rotation conveyance | | Reversal rotation conveyance | Normal rotation conveyance |
| Pinch roller | Opened | Sandwiching | Sandwiching (openable) | Opened | Sandwiching (openable) | Sandwiching | | Sandwiching | Opened |
| First thermal head | Opened | Opened | Opened | Sandwiching | Opened | Opened | | Opened | Opened |
| Roller cam | 0deg 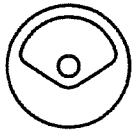 | 180deg 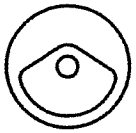 | 180deg 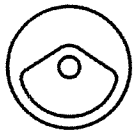 | 360deg 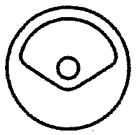 | 180deg 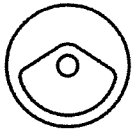 | 180deg 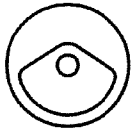 | | 540deg 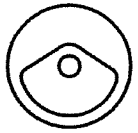 | 720deg 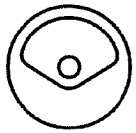 |
| Thermal head cam | 0deg 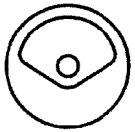 | 90deg 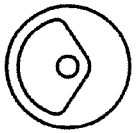 | 90deg 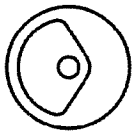 | 180deg 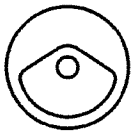 | 90deg 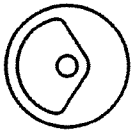 | 90deg 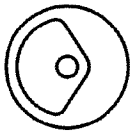 | | 270deg 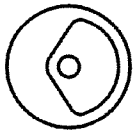 | 360deg 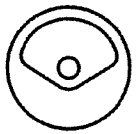 |
| Cam position sensor | ON | | | | | | | | ON |

Continue printing

Run out of paper

FIG. 31

PRINTING APPARATUS INCLUDING PLURAL PRINTHEADS AND A DRIVE MECHANISM FOR THE PLATEN ROLLERS

CROSS-REFERENCE TO RELATED APPLICATIONS

This is a Division of application Ser. No. 11/681,916 filed Mar. 5, 2007 now U.S. Pat. No. 7,891,893, the entire contents of which are incorporated herein by reference.

This application is based upon and claims the benefit of priority from prior Japanese Patent Applications No. 2006-178941, filed Jun. 29, 2006; No. 2006-178942, filed Jun. 29, 2006; No. 2006-178943, filed Jun. 29, 2006; No. 2006-178949, filed Jun. 29, 2006; No. 2006-178950, filed Jun. 29, 2006; No. 2006-178952, filed Jun. 29, 2006; No. 2006-178954, filed Jun. 29, 2006; and No. 2006-178955, filed Jun. 29, 2006, the entire contents of all of which are incorporated herein by reference.

BACKGROUND OF THE INVENTION

1. Field of the Invention

The present invention relates to a printing apparatus, and particularly to a technology in which paper can smoothly be conveyed and a technology in which a long life and high reliability are obtained in the printing apparatus.

2. Description of the Related Art

Currently, a thermal printer is used to print a receipt with a register in a restaurant and a store. Usually single-side printing is done to the receipt, and a large amount of receipt paper is used in the case of printing a large amount of information. Therefore, sometimes a double-side simultaneous printing thermal printer is used to print the information on the paper as much as possible.

In the thermal printer which simultaneously carries out printing on the both surface sides of thermal recording paper, for example, Jpn. Pat. Appln. KOKAI Publication No. 11-286147 discloses a double-side printing thermal printer including two platen rollers and two thermal heads. The thermal recording paper passes between the thermal head and the platen roller, and the printing is done on the thermal recording paper by heat applied to the thermal head.

In such kind of double-side printing thermal printer, the first platen roller and the second platen roller are rotated at the same speed while being synchronous with each other. The first thermal head carries out the printing on one of the surfaces of the thermal recording paper by the passage of the thermal recording paper between the first platen roller and the first thermal head. The second thermal head carries out the printing on the other surface of the thermal recording paper by the further passage of the thermal recording paper between the second platen roller and the second thermal head.

In the conventional double-side printing thermal printer, when the first platen roller differs slightly from the second platen roller in a feed speed, looseness of the thermal recording paper is generated between the pair of platen rollers, or tension is excessively applied to the thermal recording paper, which possibly results in a problem with print quality. Therefore, it is necessary to accurately manage an outer diameter and the feed speed of each platen roller. However, because the platen roller is made of a rubber material having elasticity, there is a limitation to the accurate management of the outer diameter and feed speed in the platen roller.

In some kinds of the printing apparatus, a first printing unit located on the downstream side of a paper conveyance path in the paper conveyance direction and a second printing unit located on the upstream side are provided, the paper is entrained between the first and second printing units to simultaneously carry out the printing on the one surface side of the paper by the first printing unit and the printing on the other surface side of the paper by the second printing unit.

The first printing unit includes a first thermal head which is a printhead and a first platen roller which conveys the paper. The first platen roller is arranged to face the first thermal head through the paper conveyance path. The second printing unit includes a second thermal head which is a printhead and a second platen roller which conveys the paper. The second platen roller is arranged to face the second thermal head through the paper conveyance path (for example, see U.S. Pat. No. 6,784,906).

Because the double-side printing is simultaneously started while the paper is entrained between the first printing unit and the second printing unit, the printing start positions are displaced between one surface and the other surface of the paper, which generates waste.

Therefore, the paper is reversely conveyed by an amount in which the waste is generated, the printing is started by the second printing unit when the paper is normally conveyed, and the printing is started by the first printing unit to eliminate the waste at the time the printing start portion reaches the first printing unit.

However, in the conventional techniques, in order to prevent the conveyance trouble caused by the looseness of the paper between the first printing unit and the second printing unit, the paper feed speed of the platen roller of the first printing unit is set faster than that of the platen roller of the second printing unit to apply the tension to the paper between the first printing unit and the second printing unit.

Therefore, when the paper is reversely conveyed such that the printing start positions are aligned with each other, the reversal feed amount of the paper by the platen roller of the first printing unit becomes larger than that of the platen roller of the second printing unit, and the looseness is generated in the paper, which causes a conveyance trouble.

Furthermore, because the number of printing units is increased to increase resistance against the paper conveyance, necessary power is increased, which results in a problem that breakage or wear of each component easily occurs.

BRIEF SUMMARY OF THE INVENTION

An object of the invention is to smoothly convey the paper without strictly managing the outer diameter of the platen roller while the proper tension is applied to the thermal recording paper, when the two platen rollers are driven by the same drive motor.

A printing apparatus according to the present invention comprises: a thermal recording paper conveyance mechanism which conveys thermal recording paper along a paper conveyance path; a first thermal head which is provided along the paper conveyance path, and is arranged to face a first surface side of the paper conveyance path; a first platen roller which is arranged to face the first thermal head across the paper conveyance path; a second thermal head which is provided along the paper conveyance path and on a supply side of the thermal recording paper with respect to the first thermal head, and is arranged to face a second surface side of the paper conveyance path; a second platen roller which is arranged to face the second thermal head across the paper conveyance path; a drive mechanism which drives the first platen roller and the second platen roller; and feed operation selecting means for placing priority on a feed operation of one of the platen rollers to a feed operation of the other platen roller, when the first platen roller differs from the second platen roller in a feed speed of the thermal recording paper.

Another object of the invention is to decrease breakage of the device and a load during the paper conveyance to enhance the life and reliability of the device by decreasing unnecessary contact and slide as much as possible.

Another printing apparatus according to the present invention comprises: a first thermal head which is arranged to come into contact with one of surfaces of thermal recording paper; a first platen roller which faces the first thermal head across the thermal recording paper; first biasing means for pressing the first thermal head against the first platen roller; a platen roller gear which is rotated while being integral with the first platen roller; a second thermal head which is arranged on an upstream side of the first thermal head in a paper feed direction to come into contact with the other surface of the thermal recording paper; a second platen roller which faces the second thermal head across the thermal recording paper; second biasing means for pressing the second thermal head toward the second platen roller; a motor; and a power transmission mechanism which transmits rotation of the motor to the platen roller gear, wherein the power transmission mechanism includes: a driving gear which is rotated by the motor; and an idler gear which is arranged to be coaxial with the second platen roller and is relatively rotatable with respect to the second platen roller, and engages both the driving gear and the platen roller gear to transmit rotation of the driving gear to the platen roller gear.

Still another printing apparatus according to the present invention comprises: a paper conveyance path formed between a paper supply unit which supplies paper and a paper discharge port which discharges the paper; a paper conveyance mechanism which is provided along the paper conveyance path and has a feed roller and a pinch roller, the feed roller and the pinch roller being provided while facing each other across the paper conveyance path; a first thermal head which is located on a first surface side of the paper conveyance path and is provided on a side of the paper discharge port with respect to the feed roller; a first platen roller which is arranged to face the first thermal head across the paper conveyance path; a second thermal head which is located on a second surface side of the paper conveyance path and is provided between the first thermal head and the feed roller; a second platen roller which is arranged to face the second thermal head across the paper conveyance path; a pinch-roller contacting and separating mechanism in which the paper is sandwiched between the pinch roller and the feed roller at least when the paper is reversely conveyed; and a thermal-head contacting and separating mechanism in which the paper is sandwiched between the first thermal head and the first platen roller during printing.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 31 is an explanatory view showing a cam position of a cam mechanism in each operation of the double-side printing thermal printer of the tenth embodiment.

DETAILED DESCRIPTION OF THE INVENTION

First Embodiment

Figure 1:
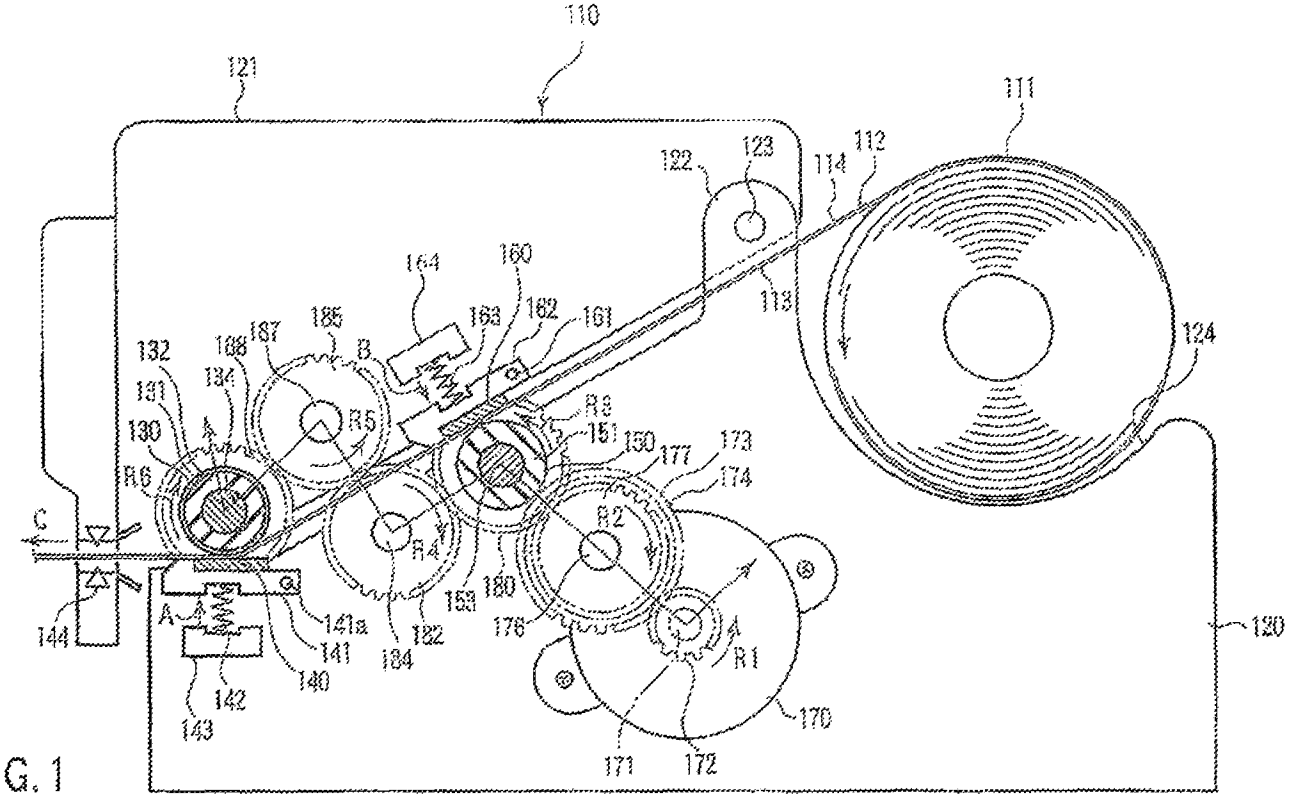
FIG. 1 is a side view schematically showing an inside of a thermal printer according to a first embodiment of the invention.

FIG. 1 schematically shows an inside of a thermal printer 110 according to a first embodiment of the invention. The thermal printer 110 can carry out printing on both surfaces of thermal recording paper 111. For example, the thermal printer 110 can be used in a cash register of a store.

Figure 2:
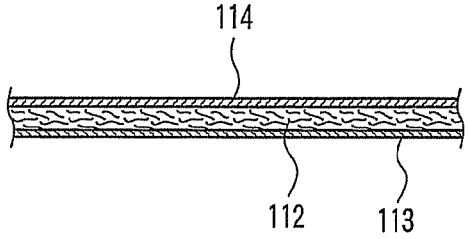
FIG. 2 is a sectional view schematically showing double-sided thermal recording paper.

As shown in FIG. 2, the thermal recording paper 111 includes a base paper 112 and heat-sensitive layers 113 and 114 which are formed on both the surfaces of the base paper 112. The first heat-sensitive layer 113 is formed on one side (for example, surface) of the base paper 112, and the second heat-sensitive layer 114 is formed on the other side (for example, backside) of the base paper 112. Each of the heat-sensitive layers 113 and 114 is made of a material which develops a desired color such as black and red when heated to a predetermined temperature or more. As shown in FIG. 1, the thermal recording paper 111 is wound in a roll shape such that the first heat-sensitive layer 113 faces the inside.

Figure 4:
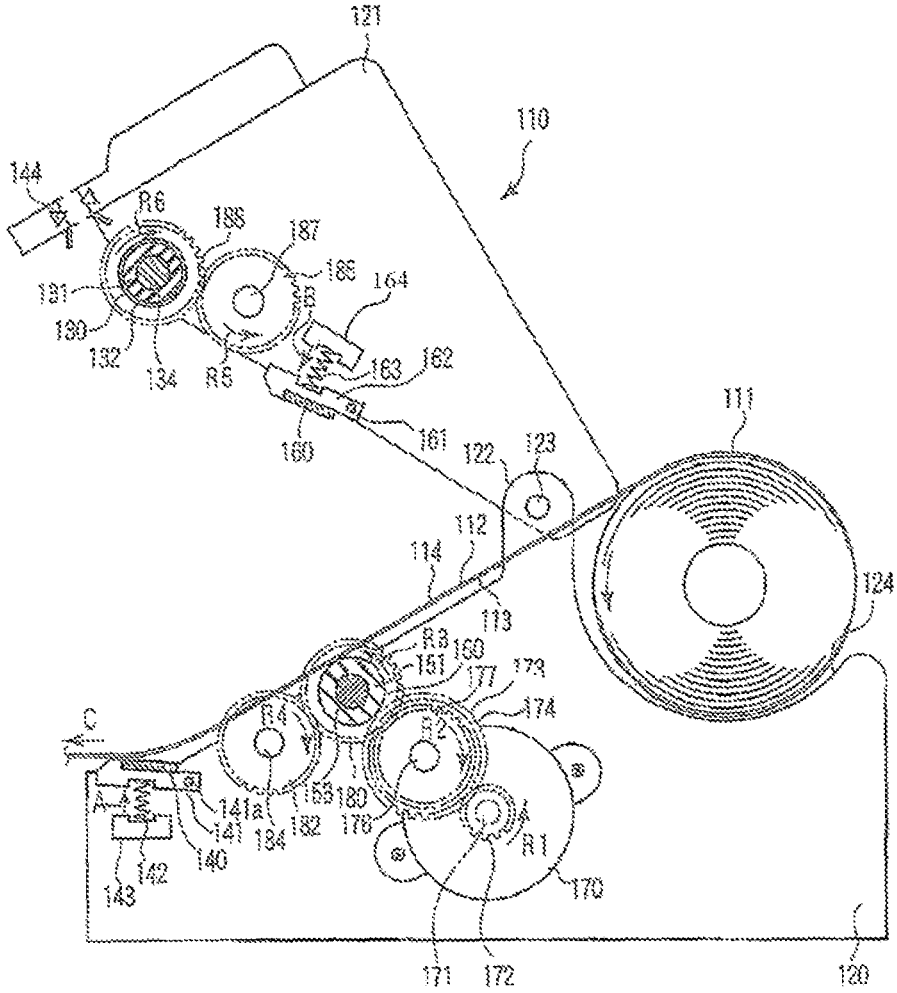
FIG. 4 is a side view schematically showing a state in which a cover of the thermal printer of FIG. 1 is opened.
Figure 5:
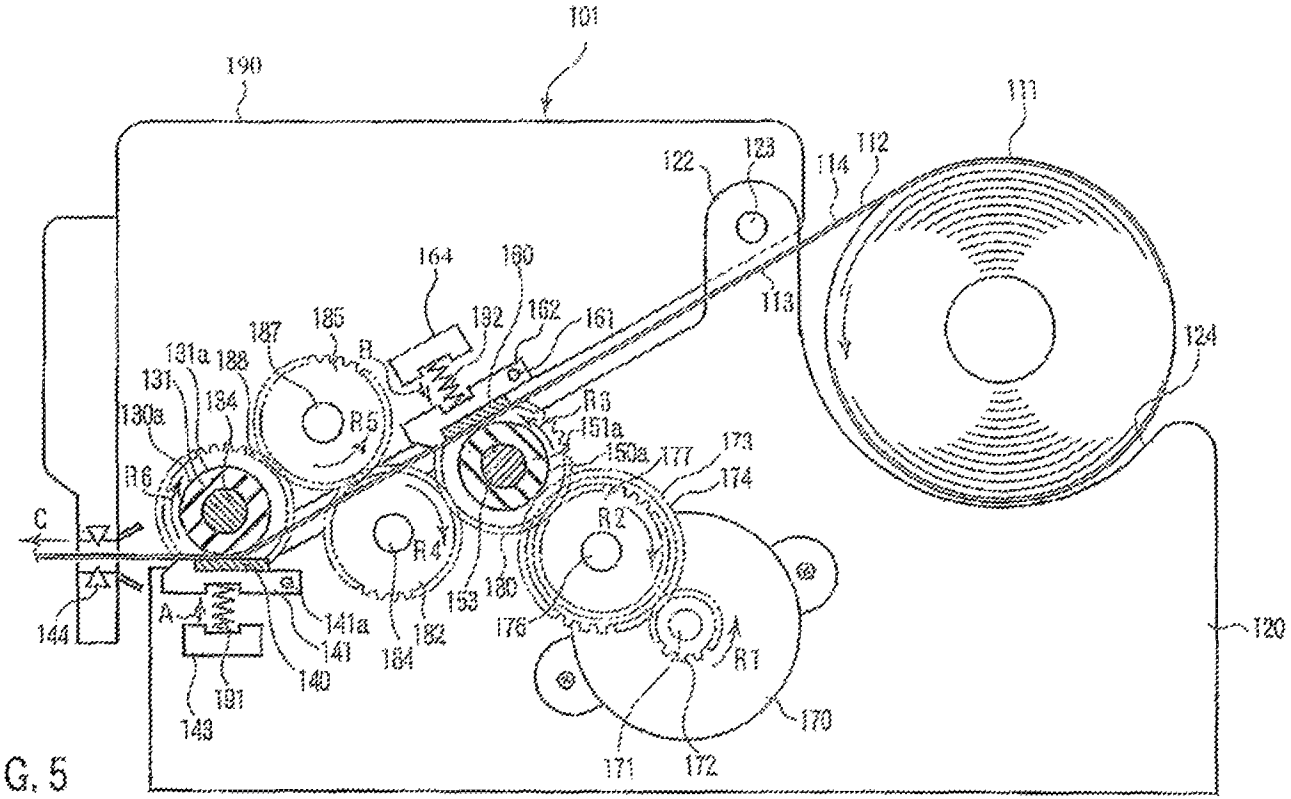
FIG. 5 is a side view schematically showing an inside of a thermal printer according to a second embodiment of the invention.

The thermal printer 110 includes a printer body 120 and an openable cover 121. The cover 121 can be opened upward while rotated about a shaft 123 of a hinge portion 122 provided in the printer body 120. The upper surface side of the printer body 120 is opened while the cover 121 is opened. FIG. 1 shows a state in which the cover 121 is closed, and FIG. 4 shows a state in which the cover 121 is opened.

Figure 3:
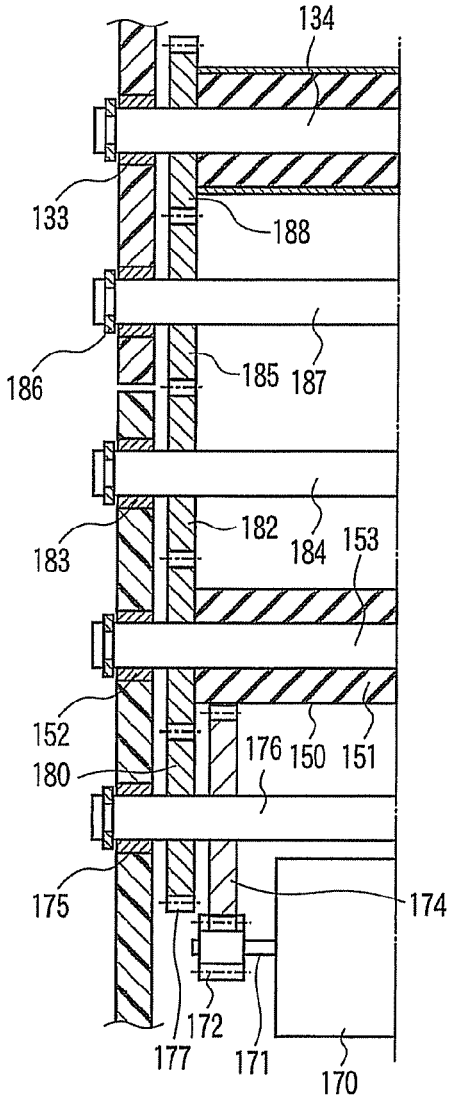
FIG. 3 is a sectional view showing a part of the thermal printer taken on line F3-F3 of FIG. 1.

A first platen roller 130 is provided in a front end portion of the cover 121 while horizontally extended. The first platen roller 130 is formed in a cylindrical shape, and the first platen roller 130 includes a roller body 131 which is made of an elastic rubber such as NBR (nitrile rubber) having a friction coefficient larger than that of metal. The first platen roller 130 includes a coating layer 132, and an outer peripheral surface of the roller body 131 is coated with the coating layer 132. The coating layer 132 is made of a material, such as PTFE (polytetrafluoroethylene resin), which has an excellent heat-resistant property and the friction coefficient smaller than that of the roller body 131. The first platen roller 130 is attached to a first platen roller shaft 134 which is rotatably supported by the cover 121 through a pair of bearings 133 (only one is shown in FIG. 3), and the first platen roller 130 is rotated about the first platen roller shaft 134 while being integral with the first platen roller shaft 134.

A paper storage portion 124 where the roll thermal recording paper 111 is arranged is formed outside in a rear portion of the printer body 120.

A first thermal head 140 is provided inside in a front portion of the printer body 120. The first thermal head 140 is arranged in a laterally-facing (substantially horizontal) and upward attitude such that the first thermal head 140 faces the first platen roller 130 while the thermal recording paper 111 is nipped between the first thermal head 140 and the first platen roller 130 in the closed state. The first thermal head 140 is arranged so as to come into contact with one of the surfaces of the thermal recording paper 111, i.e., the first heat-sensitive layer 113 on the downstream side in a paper feed direction.

The first thermal head 140 is attached to a heat sink 141 which is a radiator and is attached to the printer body 120 while being rotatable about a shaft 141*a*. First biasing means 142 is provided on the backside of the heat sink 141, i.e., below the heat sink 141. A spring member such as a helical compression spring and a torsion spring can be cited as an example of the first biasing means 142. The first biasing means 142 is arranged in a compressed state between the heat sink 141 and a spring seat 143 provided in the printer body 120. The first biasing means 142 compresses the center of the first thermal head 140 to bias the first thermal head 140 toward the first platen roller 130 in a direction of an arrow A in FIG. 1.

In a rear portion of the printer body 120, a second platen roller 150 is provided on the upstream side of the first platen roller 130 in the paper feed direction so as to be horizontally extended. The second platen roller 150 is formed in a cylindrical shape, and includes a roller body 151 which is made of an elastic rubber such as NBR (nitrile rubber) having a friction coefficient larger than that of metal. A roughening process is performed to the surface of the roller body 151 to form, e.g., elephant skin-like polishing marks on the surface. Therefore, a frictional force is increased in the conveyance direction.

The second platen roller 150 is attached to a second platen roller shaft 153 which is rotatably supported by the cover 121 through a pair of bearings 152 (only one is shown in FIG. 3), and the second platen roller 150 is rotated about the second platen roller shaft 153 while being integral with the second platen roller shaft 153.

At this point, the roller body 151 of the second platen roller 150 has the same shape as the roller body 131 of the first platen roller 130. Because of the existence of the coating layer 132, the first platen roller 130 has an outer diameter slightly larger than that of the second platen roller 150. Therefore, even if the first platen roller shaft 134 has the same rotational speed as that of the second platen roller shaft 153, the first platen roller 130 is slightly faster than the second platen roller 150 in paper feed speed.

The outer surface of the first platen roller 130 is made of PTFE, and thus has the friction coefficient smaller than that of the second platen roller 150, so that the outer surface of the first platen roller 130 is formed to be slippery.

A second thermal head 160 is provided inside on the upstream side of the first thermal head 140 in the feed direction of the thermal recording paper 111. The second thermal head 160 is attached to a heat sink 162 which is a radiator and is attached to the cover 121 while being rotatable about a shaft 161. The second thermal head 160 is arranged above the second platen roller 150 while inclined toward a lower left direction. The second thermal head 160 is arranged so as to face the second platen roller 150 while the thermal recording paper 111 is nipped between the second thermal head 160 and the second platen roller 150 in the closed state of the cover 121. The second thermal head 160 is arranged so as to come into contact with the other surface of the thermal recording paper 111, i.e., the second heat-sensitive layer 114.

Second biasing means 163 is provided on the backside of the heat sink 162, i.e., in front of and above the heat sink 162. A spring member such as a helical compression spring and a torsion spring can be cited as an example of the second biasing means 163. The second biasing means 163 is arranged in the compressed state between the heat sink 162 and a spring seat 164 provided in the cover 121. The second biasing means 163 compresses the center of the second thermal head 160 to bias the second thermal head 160 toward the second platen roller 150 in a direction of an arrow B in FIG. 1.

A motor 170 which is drive means for rotating both the first platen roller 130 and the second platen roller 150 is arranged in a lower portion of the printer body 120. An output gear 172 is attached to a rotating shaft 171 of the motor 170. The motor 170 is formed by a stepping motor which is normally and reversely rotatable, so that the motor 170 can perform reverse feed. A power transmission mechanism 173 transmits output of the motor 170 to the first platen roller 130 and the second platen roller 150. The power transmission mechanism 173 includes a reduction gear 174, a driving gear 177, a second platen roller gear 180, idler gears 182 and 185, and a first platen roller gear 188.

The reduction gear 174 is provided while engaging an output gear 172 of the motor 170. The reduction gear 174 is attached to a shaft 176 which is supported by the printer body 120 through a bearing 175, and the reduction gear 174 is rotated while being integral with the shaft 176. The driving gear 177 which is integral with the shaft 176 is provided adjacent to the reduction gear 174. The driving gear 177 is rotated while being integral with the reduction gear 174 and the shaft 176.

The second platen roller gear 180 is provided adjacent to the second platen roller 150 while engaging the driving gear 177. The second platen roller gear 180 is fixed to the second platen roller shaft 153, and the second platen roller gear 180 is rotated while being integral with the second platen roller shaft 153 and the second platen roller 150.

The idler gear 182 is provided in front of and below the second platen roller gear 180 while engaging the second platen roller gear 180. The idler gear 182 is attached to a shaft 184 which is supported by the printer body 120 through a bearing 183, and the idler gear 182 is rotated while being integral with the shaft 184.

The idler gear 185 is provided in front of and below the idler gear 182 while engaging the idler gear 182 in the closed state. The idler gear 185 is attached to a shaft 187 which is rotatably supported by the cover 121 through a bearing 186, and the idler gear 185 is rotated while being integral with the shaft 187.

As shown in FIG. 3, the first platen roller gear 188 is provided adjacent to the first platen roller 130 while engaging the idler gear 185. The first platen roller gear 188 is fixed to the first platen roller shaft 134, and is rotated while being integral with the first platen roller shaft 134 and the first platen roller 130.

After the roll thermal recording paper 111 stored in the paper storage portion 124 passes through the second thermal head 160 forward and downward, the feed direction of the thermal recording paper 111 is changed to the substantially horizontal direction, the thermal recording paper 111 passes horizontally through the first thermal head 140, and the thermal recording paper 111 is discharged forward toward the direction of an arrow C.

Thus, in the thermal printer 110 of the first embodiment, the first thermal head 140, the second platen roller 150, the motor 170, the second platen roller gear 180, the idler gear 182, and the like are arranged in the printer body 120. On the other hand, the first platen roller 130, the first platen roller gear 188, the idler gear 185, the second thermal head 160, and the like are arranged on the side of the cover 121.

When the cover 121 is opened as shown in FIG. 4, the second thermal head 160 is separated from the second platen roller 150 while the first thermal head 140 is separated from the first platen roller 130. The idler gear 185 is also separated from the idler gear 182 to open the upper surface side of the printer body 120. Therefore, the first thermal head 140, the second thermal head 160, the first platen roller 130, and the second platen roller 150 are completely exposed to the outside.

Action of the thermal printer 110 of the first embodiment will be described below. When the cover 121 is closed as shown in FIG. 1, the second thermal head 160 is pressed against the second platen roller 150 by the second biasing means 163 while the first thermal head 140 is pressed against the first platen roller 130 by the first biasing means 142, and the idler gear 182 and the idler gear 185 engage each other. At this point, the thermal recording paper 111 is set so as to pass between the first thermal head 140 and the first platen roller 130 and between the second thermal head 160 and the second platen roller 150.

When the motor 170 is rotated, the output gear 172 is rotated in the direction of an arrow R1 in FIG. 1, which rotates the reduction gear 174 and the driving gear 177 in the direction of an arrow R2. The second platen roller gear 180 and the second platen roller 150 are rotated in the direction of an arrow R3 according to the rotations of the reduction gear 174 and the driving gear 177. The thermal recording paper 111 is moved toward the first thermal head 140 in the obliquely left direction by the rotation of the second platen roller 150 while being in contact with the second thermal head 160. The second thermal head 160 can carry out the printing onto the second heat-sensitive layer 114 of the thermal recording paper 111.

The idler gear 185 is rotated in the direction R5 while the idler gear 182 is rotated in the direction R4 by the rotation of the second platen roller gear 180. As a result, the first platen roller gear 188 is rotated in the direction R6 while being integral with the first platen roller shaft 134 and the first platen roller 130. When the first platen roller 130 is rotated in the direction R6, the thermal recording paper 111 advances in the direction of the arrow C in FIG. 1 while being in contact with the first thermal head 140. In this manner, the first thermal head 140 can carry out the printing onto the first heat-sensitive layer 113 of the thermal recording paper 111.

Because the first platen roller 130 is larger than the second platen roller 150 in the outer diameter, the first platen roller 130 is faster than the second platen roller 150 in the paper feed speed. This causes tension in the thermal recording paper 111. Additionally, because the surface of the first platen roller 130 is made of PTFE having the small friction coefficient, the thermal recording paper 111 slips on the first platen roller 130 when the frictional force applied to the thermal recording paper 111 becomes a predetermined level or more. That is, the thermal recording paper 111 is conveyed while the tension is kept constant.

The printed thermal recording paper 111 is delivered from the first thermal head 140 by the rotation of the motor 170, and is cut by a cutter mechanism 144.

When the cover 121 is opened as shown in FIG. 4, the second thermal head 160 is separated from the second platen roller 150 while the first thermal head 140 is separated from the first platen roller 130. In addition, the idler gear 182 is separated from the idler gear 185. In the opened state, the upper surface side of the printer body 120 is opened, and the first and second thermal heads 140 and 160 and the first and second platen rollers 130 and 150 are exposed to the outside. Accordingly, exchange and replenishment of the thermal recording paper 111 or troubleshooting at the time of paper jam can easily be performed.

According to the thermal printer 110 of the first embodiment, the first platen roller 130 is faster than the second platen roller 150 in the paper feed speed, and the thermal recording paper 111 easily slips on the first platen roller 130 rather than the second platen roller 150. Therefore, the tension can properly be imparted to the thermal recording paper 111. Furthermore, the tension is maintained because the paper feed speed becomes faster on the downstream side in the paper feed direction. Therefore, looseness of the thermal recording paper 111 and the excessive tension can be avoided during the printing, and the high-quality double-side printing can simultaneously be done by the pair of thermal heads.

Because the first platen roller 130 is larger than the second platen roller 150 in the outer diameter, the paper feed speed can be increased. Accordingly, the paper feed speed can be adjusted without changing the rotating speeds of the first and second platen rollers 130 and 150. Therefore, the plural gears constituting the power transmission mechanism can be formed in the same number of teeth, and thereby the configuration can be simplified.

Because the outer diameter of the first platen roller 130 is increased by providing the PTFE layer on the outer surface of the first platen roller 130, the roller body 131 having the same shape can be used in both the first platen roller 130 and the second platen roller 150. Therefore, the cost can be reduced and the assembly of the thermal printer 110 is also improved.

The second platen roller gear 180 acts as the power transmission mechanism, which allows the first and second platen rollers 130 and 150 to be driven by the one motor 170 with the simple configuration. Additionally, the reverse-feed printing can be done by reversely rotating the first and second platen rollers 130 and 150.

Second Embodiment

A thermal printer 190 according to a second embodiment of the invention will be described below. The second embodiment differs from the first embodiment only in the first and second platen rollers 130 and 150 and first and second biasing means 191 and 192. Thus, the same components are designated by the same numerals and the description thereof is omitted.

In the second embodiment, a first platen roller 130*a* and a second platen roller 150*a* are formed by roller bodies 131*a* and 151*a* made of NBR respectively. The first platen roller 130*a* is slightly larger than the second platen roller 150*a* in the diameter.

The first biasing means 191 is smaller than the second biasing means 192 in a spring constant. For example, a wire diameter in the spring of the first biasing means 191 is smaller than that of the second biasing means 192. Therefore, the force with which the first thermal head 140 is pressed against the first platen roller 130*a* by the first biasing means 191 becomes smaller than the force with which the second thermal head 160 is pressed against the second platen roller 150*a* by the second biasing means 192.

A printing current supplied to the first thermal head 140 is set larger than a printing current supplied to the second thermal head 160.

The same effects as the thermal printer 110 of the first embodiment are obtained in the second embodiment. That is, the first biasing means 191 is smaller than the second biasing means 192 in the pressing force, which allows the paper to slip easily between the first platen roller 130*a* and the first thermal head 140. The printing current is increased in the first thermal head 140 having the smaller pressing force, which allows the double-side printing to be done with high accuracy. Alternatively, instead of the adjustment of the printing current, the double-side printing may be done with high accuracy using the thermal recording paper 111 in which the first heat-sensitive layer 113, coming into contact with the first thermal head 140 having the smaller pressing force, easily develops color rather than the second heat-sensitive layer 114.

In the second embodiment, the spring constant is adjusted by adjusting the wire diameter of the spring. Alternatively, the pressing force may be adjusted by adjusting the arrangement in the initial state. For example, the second biasing means 192 is arranged in the closed state while further compressed compared with the first biasing means 191, and thereby the pressing force of the first biasing means 191 can be set smaller than that of the second biasing means 192. In this case, the first and second biasing means 191 and 192 can be made of the same material, so that the cost can be reduced and productivity is also improved.

In the second embodiment, the second platen roller 150*a* is slightly smaller than the first platen roller 130*a* in the outer diameter, because the second platen roller 150*a* is pressed with the pressing force larger than that applied to the first platen roller 130*a*. Accordingly, the paper feed speed and slipperiness can be adjusted, even if the first and second platen rollers 130*a* and 150*a* are set at the same rotating speed while made of the same material.

The invention is not limited to the above embodiments. For example, although the slipperiness is obtained by the frictional force in the first embodiment while the slipperiness is obtained by the pressing force in the second embodiment, the first and second embodiments may be combined. That is, the coating layer 132 is formed in the first platen roller 130, the roughening process is performed to the second platen roller 150, and the pressing force of the first biasing means 142 may be set larger than that of the second biasing means 163. In the above embodiments, the paper feed speed are adjusted by the outer diameters of the first and second platen rollers 130 and 150. Alternatively, the rotating speeds are adjusted by changing the shapes of the gears constituting the power transmission mechanism, and thereby the paper feed speed may be adjusted.

Third Embodiment

Figure 6:
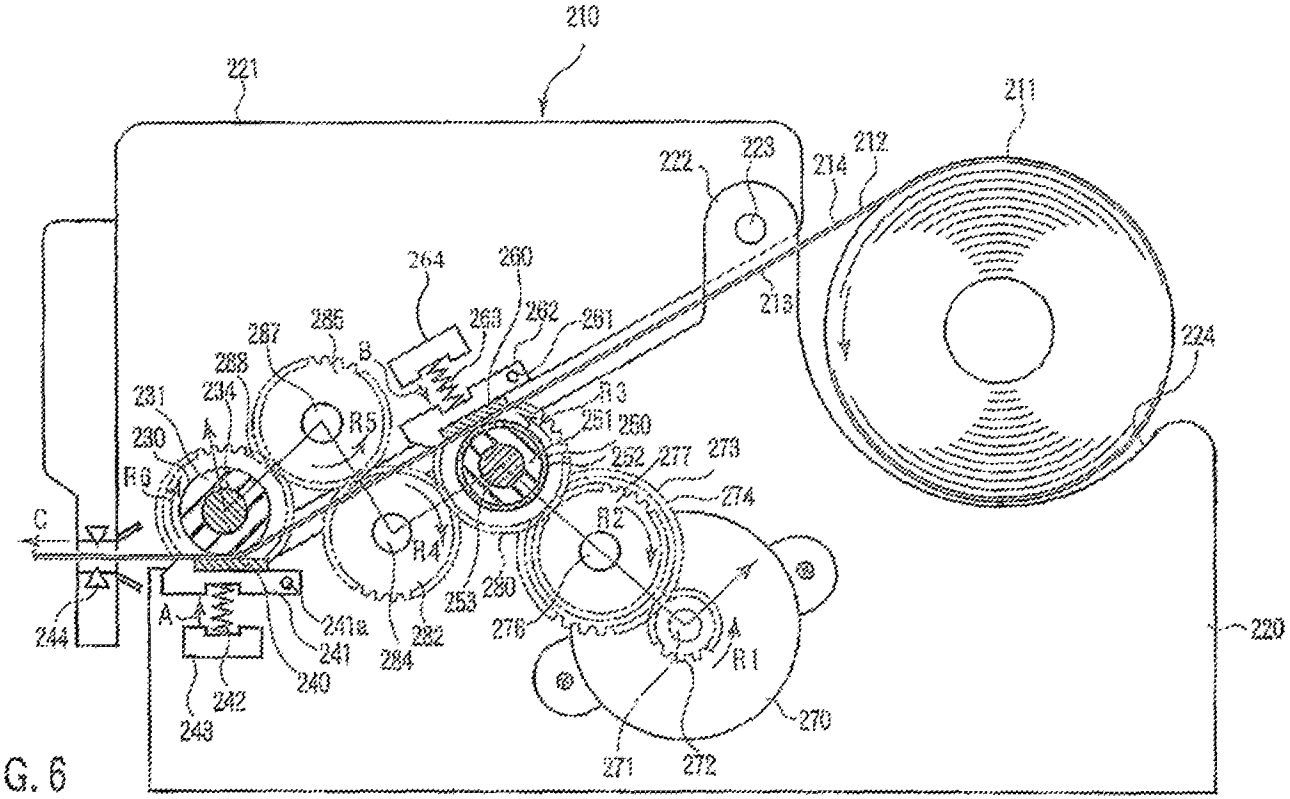
FIG. 6 is a side view schematically showing an inside of a thermal printer according to a third embodiment of the invention.

FIG. 6 schematically shows an inside of a thermal printer 210. The thermal printer 210 can carry out printing on both surfaces of thermal recording paper 211. For example, the thermal printer 210 can be used in a cash register of a store.

Figure 7:
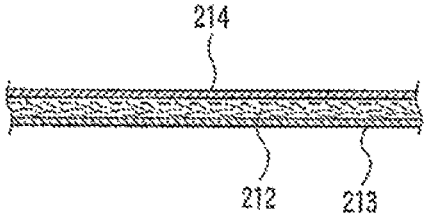
FIG. 7 is a side view schematically showing double-sided thermal recording paper.

As shown in FIG. 7, the thermal recording paper 211 includes a base paper 212 and heat-sensitive layers 213 and 214 which are formed on both the surfaces of the base paper 212. The first heat-sensitive layer 213 is formed on one side (for example, surface) of the base paper 212, and the second heat-sensitive layer 214 is formed on the other side (for example, backside) of the base paper 212. Each of the heat-sensitive layers 213 and 214 is made of a material which develops a desired color such as black and red when heated to a predetermined temperature or more. As shown in FIG. 6, the thermal recording paper 211 is wound in the roll shape such that the first heat-sensitive layer 213 faces the inside.

Figure 9:
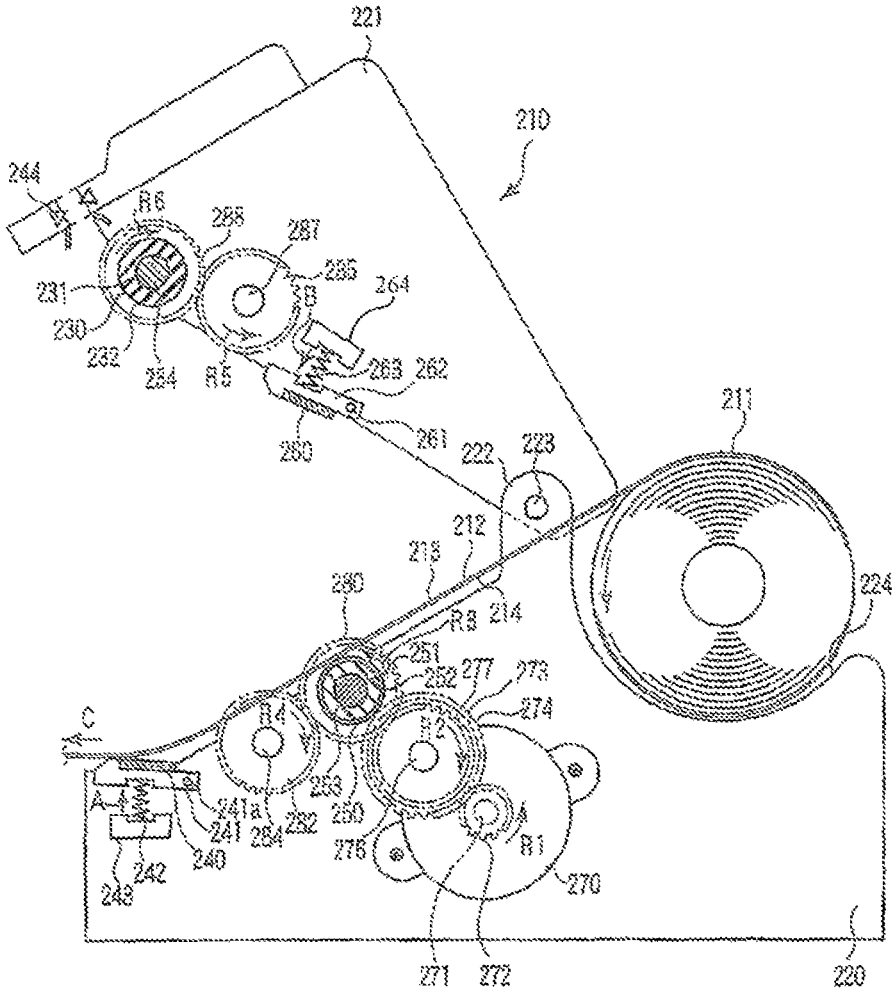
FIG. 9 is a side view schematically showing a state in which a cover of the thermal printer of FIG. 6 is opened.

The thermal printer 210 includes a printer body 220 and an openable cover 221. The cover 221 can be opened upward while rotated about a shaft 223 of a hinge portion 222 provided in the printer body 220. The upper surface side of the printer body 220 is opened while the cover 221 is opened. FIG. 6 shows a state in which the cover 221 is closed, and FIG. 9 shows a state in which the cover 221 is opened.

Figure 8:
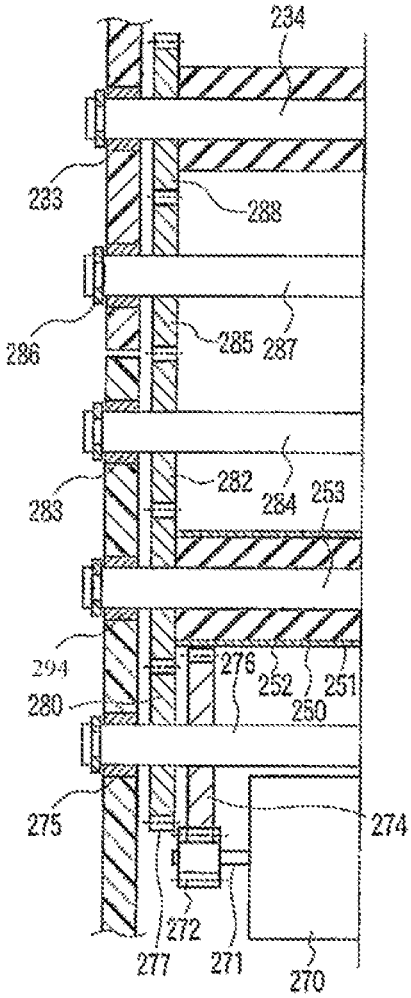
FIG. 8 is a sectional view showing a part of the thermal printer taken on line F3-F3 of FIG. 6.

A first platen roller 230 is provided in a front end portion of the cover 221 while horizontally extended. The first platen roller 230 is formed in the cylindrical shape, and includes a roller body 231 which is made of an elastic rubber such as NBR (nitrile rubber) having a friction coefficient larger than that of metal. The roughening process is performed to the surface of the roller body 231 to form, e.g., elephant skin-like polishing marks on the surface. Therefore, the frictional force is increased in the conveyance direction. The first platen roller 230 is attached to a first platen roller shaft 234 which is rotatably supported by the cover 221 through a pair of bearings 233 (only one is shown in FIG. 8), and the first platen roller 230 is rotated about the first platen roller shaft 234 while being integral with the first platen roller shaft 234.

A paper storage portion 224 where the roll thermal recording paper 211 is arranged is formed outside in the rear portion of the printer body 220.

A first thermal head 240 is provided inside in the front portion of the printer body 220. The first thermal head 240 is arranged in a laterally-facing (substantially horizontal) and upward attitude such that the first thermal head 240 faces the first platen roller 230 while the thermal recording paper 211 is nipped between the first thermal head 240 and the first platen roller 230 in the closed state. The first thermal head 240 is arranged so as to come into contact with one of the surfaces of the thermal recording paper 211, i.e., the first heat-sensitive layer 213 on the downstream side in the paper feed direction.

The first thermal head 240 is attached to a heat sink 241 which is a radiator and is attached to the printer body 220 while being rotatable about a shaft 241*a*. First biasing means 242 is provided on the backside of the heat sink 241, i.e., below the heat sink 241. A spring member such as a helical compression spring and a torsion spring can be cited as an example of the first biasing means 242. The first biasing means 242 is arranged in the compressed state between the heat sink 241 and a spring seat 243 provided in the printer body 220. The first biasing means 242 compresses the center of the first thermal head 240 to bias the first thermal head 240 toward the first platen roller 230 in the direction of the arrow A in FIG. 6.

In a rear portion of the printer body 220, a second platen roller 250 is provided on the upstream side of the first platen roller 230 in the paper feed direction so as to be horizontally extended. The second platen roller 250 is formed in a cylindrical shape, and includes a roller body 251 which is made of an elastic rubber such as NBR (nitrile rubber) having a friction coefficient larger than that of metal. The second platen roller 250 includes a coating layer 252, and the outer peripheral surface of the roller body 251 is coated with the coating layer 252. The coating layer 252 is made of a material, such as PTFE (polytetrafluoroethylene resin), which has an excellent heat-resistant property and the friction coefficient smaller than that of the roller body 251.

The second platen roller 250 is attached to a second platen roller shaft 253 which is rotatably supported by the cover 221 through a pair of bearings 294 (only one is shown in FIG. 8). The second platen roller 250 is rotated about the second platen roller shaft 253 while being integral with the second platen roller shaft 253.

The first platen roller 230 has an outer diameter slightly larger than that of the second platen roller 250. Thus, even if the first platen roller shaft 234 has the same rotational speed as that of the second platen roller shaft 253, the first platen roller 230 is slightly faster than the second platen roller 250 in the paper feed speed.

The outer surface of the second platen roller 250 is made of PTFE, and thus has the friction coefficient smaller than that of the first platen roller 230, so that the outer surface of the second platen roller 250 is formed to be slippery.

A second thermal head 260 is arranged on the upstream side of the first thermal head 240 in the feed direction of the thermal recording paper 211. The second thermal head 260 is attached to a heat sink 262 which is a radiator and is attached to the cover 221 while being rotatable about a shaft 261. The second thermal head 260 is arranged above the second platen roller 250 while inclined toward the lower left direction. The second thermal head 260 is arranged so as to face the second platen roller 250 while the thermal recording paper 211 is nipped between the second thermal head 260 and the second platen roller 250 in the closed state of the cover 221. The second thermal head 260 is arranged so as to come into contact with the other surface of the thermal recording paper 211, i.e., the second heat-sensitive layer 214.

Second biasing means 263 is provided on the backside of the heat sink 262, i.e., in front of and above the heat sink 262. A spring member such as a helical compression spring and a torsion spring can be cited as an example of the second biasing means 263. The second biasing means 263 is arranged in the compressed state between the heat sink 262 and a spring seat 264 provided in the cover 221. The second biasing means 263 compresses the center of the second thermal head 260 to bias the second thermal head 260 toward the second platen roller 250 in the direction of the arrow B in FIG. 6.

A motor 270 which is drive means for rotating both the first platen roller 230 and the second platen roller 250 is arranged in the lower portion of the printer body 220. An output gear 272 is attached to a rotating shaft 271 of the motor 270. The motor 270 is formed by a stepping motor which is normally and reversely rotatable, so that the motor 270 can perform the reverse feed. A power transmission mechanism 273 transmits output of the motor 270 to the first platen roller 230 and the second platen roller 250. The power transmission mechanism 273 includes a reduction gear 274, a driving gear 277, a second platen roller gear 280, idler gears 282 and 285, and a first platen roller gear 288.

The reduction gear 274 is provided while engaging an output gear 272 of the motor 270. The reduction gear 274 is attached to a shaft 276 which is supported by the printer body 220 through a bearing 275, and the reduction gear 274 is rotated while being integral with the shaft 276. The driving gear 277 which is integral with the shaft 276 is provided adjacent to the reduction gear 274. The driving gear 277 is rotated while being integral with the reduction gear 274 and the shaft 276.

The second platen roller gear 280 is provided adjacent to the second platen roller 250 while engaging the driving gear 277. The second platen roller gear 280 is fixed to the second platen roller shaft 253, and is rotated while being integral with the second platen roller shaft 253 and the second platen roller 250.

The idler gear 282 is provided in front of and below the second platen roller gear 280 while engaging the second platen roller gear 280. The idler gear 282 is attached to a shaft 284 which is supported by the printer body 220 through a bearing 283, and the idler gear 282 is rotated while being integral with the shaft 284.

The idler gear 285 is provided in front of and below the idler gear 282 while engaging the idler gear 282 in the closed state. The idler gear 285 is attached to a shaft 287 which is rotatably supported by the cover 221 through a bearing 286, and the idler gear 285 is rotated while being integral with the shaft 287.

As shown in FIG. 8, the first platen roller gear 288 is provided adjacent to the first platen roller 230 while engaging the idler gear 285. The first platen roller gear 288 is fixed to the first platen roller shaft 234, and is rotated while being integral with the first platen roller shaft 234 and the first platen roller 230.

After the roll thermal recording paper 211 stored in the paper storage portion 224 passes through the second thermal head 260 forward and downward, the feed direction of the thermal recording paper 211 is changed to the substantially horizontal direction, the thermal recording paper 211 passes horizontally through the first thermal head 240, and is discharged forward toward the direction of the arrow C.

Thus, in the thermal printer 210 of the third embodiment, the first thermal head 240, the second platen roller 250, the motor 270, the second platen roller gear 280, the idler gear 282, and the like are arranged in the printer body 220. On the other hand, the first platen roller 230, the first platen roller gear 288, the idler gear 285, the second thermal head 260, and the like are arranged on the side of the cover 221.

When the cover 221 is opened as shown in FIG. 9, the second thermal head 260 is separated from second platen roller 250 while the first thermal head 240 is separated from the first platen roller 230. The idler gear 285 is also separated from the idler gear 282 to open the upper surface side of the printer body 220. Therefore, the first thermal head 240, the second thermal head 260, the first platen roller 230, and the second platen roller 250 are completely exposed to the outside.

The action of the thermal printer 210 of the third embodiment will be described below. When the cover 221 is closed as shown in FIG. 6, the second thermal head 260 is pressed against the second platen roller 250 by the second biasing means 263 while the first thermal head 240 is pressed against the first platen roller 230 by the first biasing means 242, and the idler gear 282 and the idler gear 285 engage each other. At this point, the thermal recording paper 211 is set so as to pass between the first thermal head 240 and the first platen roller 230 and between the second thermal head 260 and the second platen roller 250.

When the motor 270 is rotated, the output gear 272 is rotated in the direction of the arrow R1 in FIG. 6, which rotates the reduction gear 274 and the driving gear 277 in the direction of the arrow R2. The second platen roller gear 280 and the second platen roller 250 are rotated in the direction of the arrow R3 according to the rotations of the reduction gear 274 and the driving gear 277. The thermal recording paper 211 is moved toward the first thermal head 240 in the obliquely left direction by the rotation of the second platen roller 250 while being in contact with the second thermal head 260. The second thermal head 260 can carry out the printing onto the second heat-sensitive layer 214 of the thermal recording paper 211.

The idler gear 285 is rotated in the direction R5 while the idler gear 282 is rotated in the direction R4 by the rotation of the second platen roller gear 280. As a result, and thereby the first platen roller gear 288 is rotated in the direction R6 while being integral with the first platen roller shaft 234 and first platen roller 230. When the first platen roller 230 is rotated in the direction R6, the thermal recording paper 211 advances in the direction of the arrow C in FIG. 6 while being in contact with the first thermal head 240. As a result, the first thermal head 240 can carry out the printing onto the first heat-sensitive layer 213 of the thermal recording paper 211.

Because the first platen roller 230 is larger than the second platen roller 250 in the outer diameter, the first platen roller 230 is faster than the second platen roller 250 in the paper feed speed. This causes tension in the thermal recording paper 211. Additionally, because the surface of the second platen roller 250 is made of PTFE having the small friction coefficient, the frictional force applied to the thermal recording paper 211 is smaller than the frictional force applied to the first platen roller 230. Therefore, the thermal recording paper 211 slips on the second platen roller 250 due to the difference in frictional force. That is, the thermal recording paper 211 is conveyed while the tension is kept constant.

A predetermined amount of the printed thermal recording paper 211 is delivered from the first thermal head 240 by the rotation of the motor 270, and the thermal recording paper 211 is cut by a cutter mechanism 244.

When the cover 221 is opened as shown in FIG. 9, the second thermal head 260 is separated from the second platen roller 250 while the first thermal head 240 is separated from the first platen roller 230. In addition, the idler gear 282 is separated from the idler gear 285. In the opened state, the upper surface side of the printer body 220 is opened, and the first and second thermal heads 240 and 260 and the first and second platen rollers 230 and 250 are completely exposed to the outside. Accordingly, exchange and replenishment of the thermal recording paper 211 or the troubleshooting at the time of the paper jam can easily be performed.

According to the thermal printer 210 of the third embodiment, the first platen roller 230 is faster than the second platen roller 250 in the paper feed speed, and the thermal recording paper 211 easily slips on the second platen roller 250 rather than the first platen roller 230. Therefore, the tension can properly be imparted to the thermal recording paper 211. Furthermore, the tension is maintained because the paper feed speed becomes faster on the downstream side in the paper feed direction. Therefore, the looseness of the thermal recording paper 211 and the excessive tension can be avoided during the printing, and the high-quality double-side printing can simultaneously be done by the pair of thermal heads.

The first platen roller 230 is larger than the second platen roller 250 in the outer diameter, which generates the difference in the paper feed speed. Accordingly, the paper feed speed can be adjusted without changing the rotating speeds of the first and second platen rollers 230 and 250. Therefore, the plural gears constituting the power transmission mechanism can be formed in the same number of teeth, and thereby the configuration can be simplified.

The second platen roller gear 280 acts as the power transmission mechanism, which allows the first and second platen rollers 230 and 250 to be driven by the one motor 270 with the simple configuration. Additionally, the reverse-feed printing can be done by reversely rotating the first and second platen rollers 230 and 250. In the third embodiment, the rotating speed of the first platen roller 230 located on the downstream side in the paper feed direction is set to a reference speed and the friction coefficient is increased, so that the thermal recording paper 211 is not displaced between the first platen roller 230 and the first thermal head 240. Accordingly, the reverse-feed printing can accurately be done to the thermal recording paper 211 at the end portion on the downstream side in the paper feed direction.

Fourth Embodiment

Figure 10:
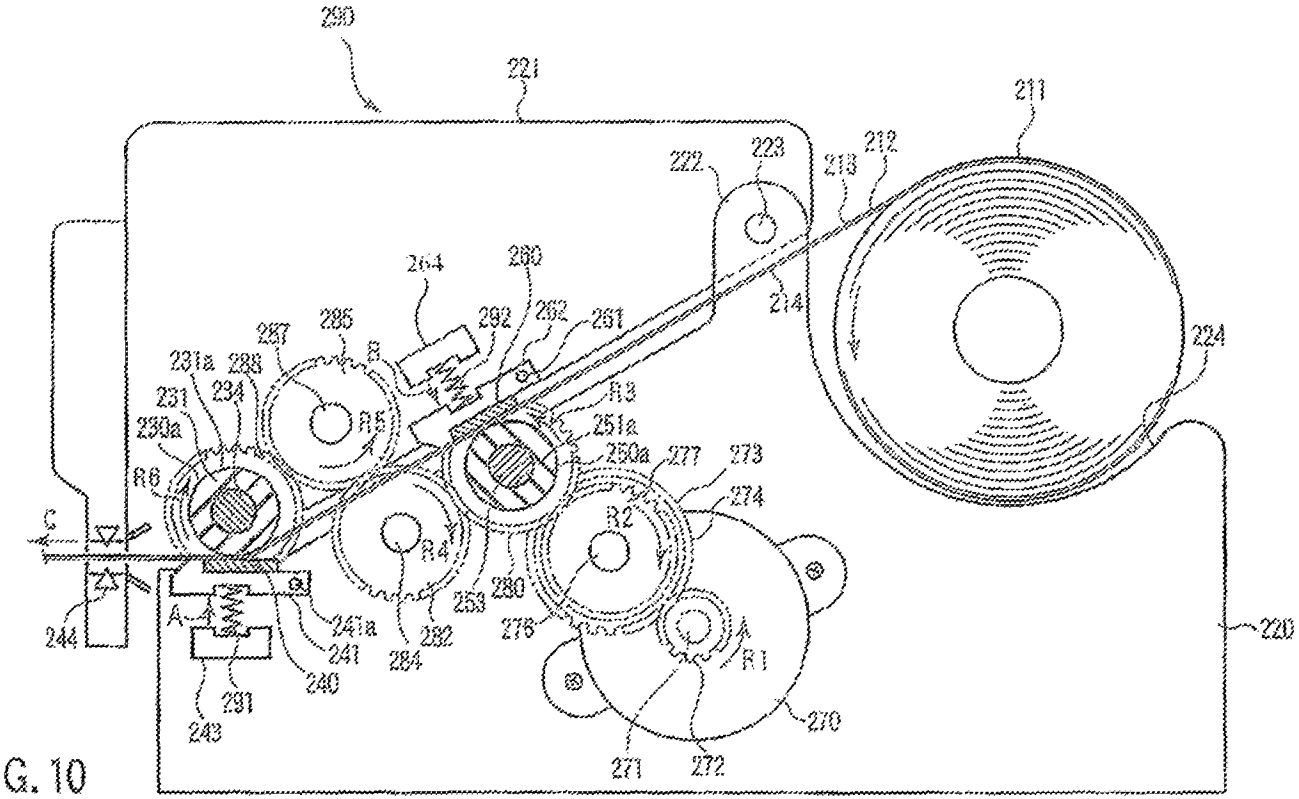
FIG. 10 is a side view schematically showing an inside of a thermal printer according to a fourth embodiment of the invention.

A thermal printer 290 according to a fourth embodiment of the invention will be described below with reference to FIG. 10. The fourth embodiment differs from the third embodiment only in the first and second platen rollers 230 and 250 and the first and second biasing means 291 and 292. Thus, the same components are designated by the same numerals and the description thereof is omitted.

In the fourth embodiment, a first platen roller 230*a* and a second platen roller 250*a* are formed by roller bodies 231*a* and 251*a* made of NBR respectively. The first platen roller 230*a* is slightly larger than the second platen roller 250*a* in the diameter.

The first biasing means 291 is larger than the second biasing means 292 in a spring constant. For example, the wire diameter in the spring of the first biasing means 291 is larger than that of the second biasing means 292. Therefore, the force with which the first thermal head 240 is pressed against the first platen roller 230*a* by the first biasing means 291 becomes larger than the force with which the second thermal head 260 is pressed against the second platen roller 250*a* by the second biasing means 292.

The printing current supplied to the first thermal head 240 is set smaller than the printing current supplied to the second thermal head 260.

The same effects as the thermal printer 210 of the third embodiment are obtained in the fourth embodiment. That is, the first biasing means 291 is larger than the second biasing means 292 in the pressing force, which allows the paper to slip easily between the second platen roller 250*a* and the second thermal head 260. The printing current is decreased in the first thermal head 240 having the larger pressing force, which allows the double-side printing to be done with high accuracy. Alternatively, instead of the adjustment of the printing current, the double-side printing may be done with high accuracy using the thermal recording paper 211 in which the second heat-sensitive layer 214, coming into contact with the second thermal head 260 having the smaller pressing force, easily develops color rather than the first heat-sensitive layer 213. In the fourth embodiment, the rotating speed of the first platen roller 230 located on the downstream side in the paper feed direction is set to a reference speed and the pressing force of the first platen roller 230 is increased, so that the reverse-feed printing can accurately be done to the thermal recording paper 211 at the end portion on the downstream side in the paper feed direction.

In the fourth embodiment, the spring constant is adjusted by adjusting the wire diameter of the spring. Alternatively, the pressing force may be adjusted by adjusting the arrangement in the initial state. For example, the first biasing means 291 is arranged in the closed state while further compressed compared with the second biasing means 292, and thereby the pressing force of the first biasing means 291 can be set larger than that of the second biasing means 292. In this case, the first and second biasing means 291 and 292 can be made of the same material, so that the cost can be reduced and the productivity is also improved.

Although the slipperiness is obtained by the frictional force in the third embodiment while the slipperiness is obtained by the pressing force in the fourth embodiment, the third and fourth embodiments may be combined. That is, the coating layer 232 is formed in the second platen roller 250, the roughening process is performed to the first platen roller 230, and the pressing force of the first biasing means 242 may be set smaller than that of the second biasing means 263.

In the third and fourth embodiments, the paper feed speed is adjusted by the outer diameters of the first and second platen rollers 230 and 250. Alternatively, the rotating speeds are adjusted by changing the shapes of the gears constituting the power transmission mechanism, and thereby the paper feed speed may be adjusted.

The thermal printer 210 of the invention can also be used in carrying out the printing onto single-side thermal recording paper 211 having the heat-sensitive layer only on the single surface.

Fifth Embodiment

Figure 11:
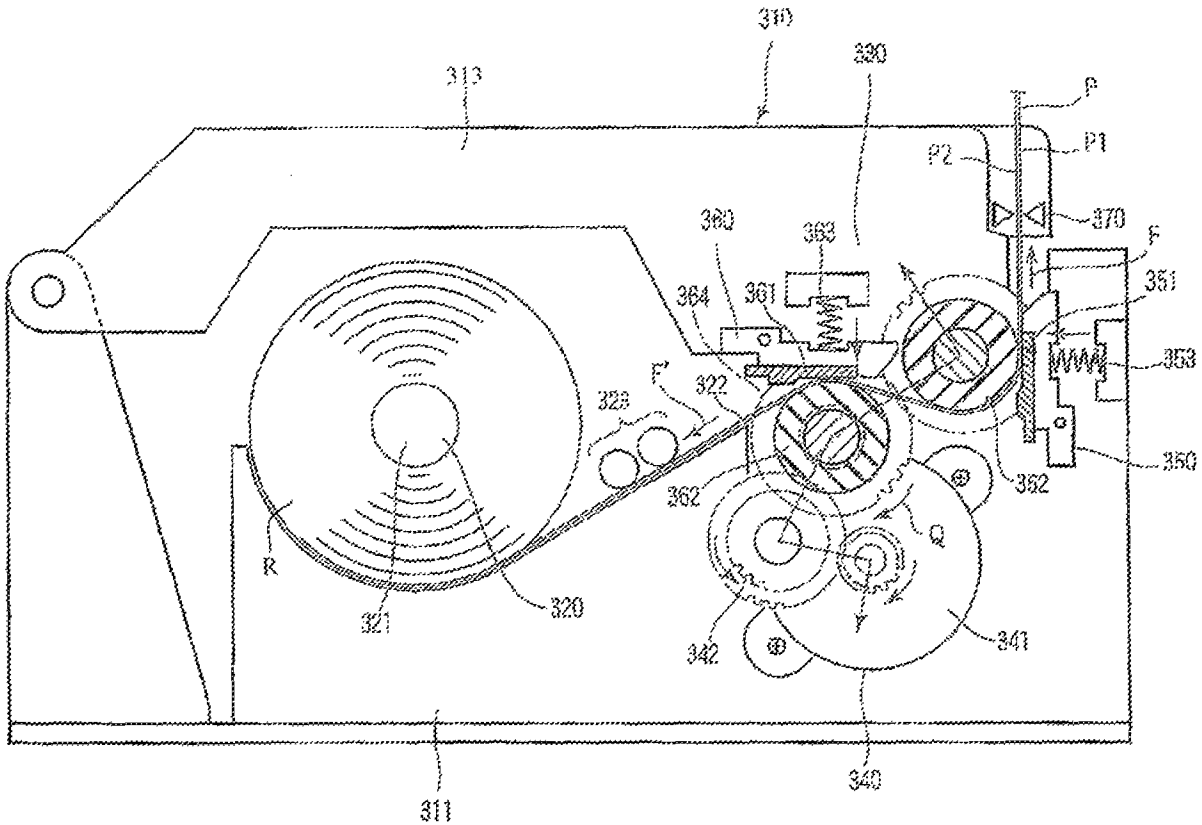
FIG. 11 is a longitudinal sectional view schematically showing a double-side printing thermal printer according to a fifth embodiment of the invention.
Figure 12:
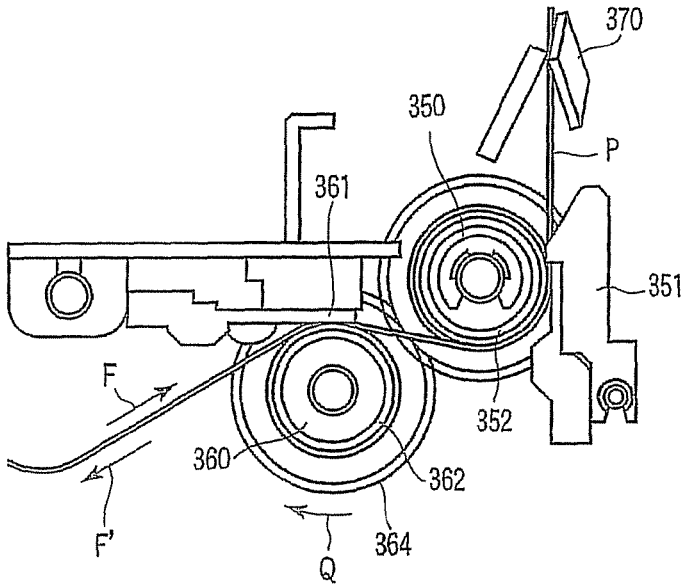
FIG. 12 is a side view showing a main part of a printing mechanism incorporated into the double-side printing thermal printer of the fifth embodiment.

FIG. 11 is a longitudinal sectional view schematically showing a double-side printing thermal printer 310 according to a fifth embodiment of the invention, and FIG. 12 is a side view showing a main part of a printing mechanism 330 incorporated into the double-side printing thermal printer 310. In FIG. 11, the letter P designates double-sided thermal recording paper.

The double-side printing thermal printer 310 includes a chassis 311 and an openable cap 313. Each mechanism is accommodated in the double-side printing thermal printer 310, and the openable cap 313 is provided while being openable with respect to the chassis 311.

A thermal recording paper supply unit 320 and the printing mechanism 330 are accommodated in the chassis 311. The thermal recording paper supply unit 320 rotatably supports a thermal recording paper roller R about which the thermal recording paper P is wound, and the thermal recording paper supply unit 320 supplies the thermal recording paper P. The printing mechanism 330 carries out the printing to the supplied thermal recording paper P.

The thermal recording paper supply unit 320 includes a retaining unit 321 and a feed mechanism 323. The retaining unit 321 retains the thermal recording paper roller R. The feed mechanism 323 conveys the thermal recording paper P from the retaining unit 321 to the printing mechanism 330 along a paper conveyance path 322. In the drawings, the letter F designates a conveyance direction and the letter F' designates a reverse conveyance direction.

The printing mechanism 330 includes a drive mechanism 340, a first printing unit 350, a second printing unit 360, and a cutting mechanism 370. The first printing unit 350, the second printing unit 360, and the cutting mechanism 370 are provided along the paper conveyance path 322.

The drive mechanism 340 includes a drive motor 341 and a gear mechanism 342 which transmits a torque generated by the drive motor 341 to each unit.

The first printing unit 350 includes a first thermal head 351, a first platen roller 352, and a spring 353. The first thermal head 351 is arranged so as to face one side (first surface side) orthogonal to a direction in which the paper conveyance path 322 is extended. The first platen roller 352 is arranged so as to face the first thermal head 351 across the paper conveyance path 322. The spring 353 biases the first thermal head 351 toward the side of the first platen roller 352. The first platen roller 352 is driven by the gear mechanism 342.

The second printing unit 360 includes a second thermal head 361, a second platen roller 362, a spring 363, and a one-way gear (selective torque transmission mechanism) 364. The second thermal head 361 is arranged so as to face the other side (second surface side) orthogonal to the direction in which the paper conveyance path 322 is extended. The second platen roller 362 is arranged so as to face the second thermal head 361 across the paper conveyance path 322. The spring 363 biases the second thermal head 361 toward the side of the second platen roller 362. The one-way gear 364 selectively transmits the torque from the gear mechanism 342 to the second platen roller 362. The one-way gear 364 is freely rotated (free state) to disconnect the torque when the second platen roller 362 is rotated in the conveyance direction (arrow Q in FIG. 12) of the thermal recording paper P, and the one-way gear 364 engages the gear mechanism 342 (locked state) to transmit the torque when the second platen roller 362 is reversely rotated due to positioning of the printing position and the like. That is, both the first platen roller 352 and the second platen roller 362 are driven by the gear mechanism 342.

The one-way gear 364 has a backlash angle θ, when the rotating direction is changed from the conveyance direction to the reverse conveyance direction, namely, when the free state in which the torque is disconnected is changed to the locked state in which the torque is transmitted. Accordingly, the free state is not directly changed to the locked state, but the unlocked state exists in several degrees of the backlash angle θ, and the rotation of the second platen roller 362 is not started although the first platen roller 352 is rotated in the reverse conveyance direction. This causes the thermal recording paper P to be loosened between the first platen roller 352 and the second platen roller 362. In order to eliminate the looseness, a circumferential velocity of the second platen roller 362 is designed to be faster than that of the first platen roller 352.

When the state in which the second platen roller 362 is faster than the first platen roller 352 in the circumferential velocity is continued, the excessive tensile force is applied to the thermal recording paper P. However, a distance of the reverse conveyance is usually as short as 10 mm, and the reverse conveyance is performed only to an extent that the looseness caused by the backlash angle is eliminated. Therefore, there is generated no problem.

Specifically, assume that the backlash angle θ is 2.5 degrees, an amount of reverse conveyance is 10.0 mm, and the first and second platen rollers 352 and 362 have the same reduction ratio. In this case, when the outer diameter of the first platen roller 352 is set to 10.50 mm, the rotation angle becomes 109.13 degrees. On the other hand, the rotation angle of the second platen roller 362 is set to 107.13 degrees which is smaller than that of the first platen roller 352 by 2 degrees smaller than the backlash angle θ of 2.5 degrees, so that it is necessary that the outer diameter of the second platen roller 362 is set to 10.69 mm or less.

In the above example, the first and second platen rollers 352 and 362 have the same rotation angle. However, the fifth embodiment can be applied even if the first and second platen rollers 352 and 362 have the different rotation angles. That is, it is necessary that a difference between a product of the rotation angle and outer diameter of the first platen roller 352 and the rotation angle and outer diameter of the second platen roller 362 be smaller than a product of the outer diameter of the second platen roller 362 and the backlash angle θ in which the one-way gear 364 is changed from the free state and the locked state.

The double-side printing thermal printer 310 having the above configuration carries out the printing as follows. When a printing command is inputted from the outside, the drive motor 341 is rotated in a predetermined direction. The rotation of the drive motor 341 drives the feed mechanism 323 through the gear mechanism 342 to drive the thermal recording paper P toward the discharge direction.

The gear mechanism 342 further rotates the first platen roller 352 in the conveyance direction of the thermal recording paper P. On the other hand, the second platen roller 362 is only driven by the thermal recording paper P because the torque is disconnected by the one-way gear 364. Therefore, the tensile force is applied to the thermal recording paper P by the first platen roller 352, and the thermal recording paper P is conveyed toward the discharge direction irrespective of the outer-diameter sizes of the first and second platen roller 352 and 362 while a constant tension is always maintained.

In this state, the thermal recording paper P is conveyed to the second printing unit 360. The second printing unit 360 starts the printing onto the second surface P2 of the thermal recording paper P. When the thermal recording paper P reaches the first printing unit 350, the first printing unit 350 starts the printing onto the first surface P1 of the thermal recording paper P.

When the thermal recording paper P is reversely conveyed due to the positioning of the printing position and the like, the first and second platen rollers 352 and 362 engage the gear mechanism 342 (locked state), and are driven by the gear mechanism 342. In consideration of the backlash angle θ of the one-way gear 364, the circumferential velocity of the second platen roller 362 is set so as to be faster than that of the first platen roller 352, so that the looseness of the thermal recording paper P caused by the backlash can be eliminated to prevent the generation of wrinkle.

When the printing is completed to both sides of the thermal recording paper P, the feed mechanism 323 delivers the thermal recording paper P to a cutting mechanism 370, and the thermal recording paper P is cut by the cutting mechanism 370.

Thus, the double-side printing thermal printer 310 of the fifth embodiment can carry out the printing onto both sides of the thermal recording paper P. Furthermore, when the first and second platen rollers 352 and 362 are driven by the same drive motor 341, the thermal recording paper P can smoothly be conveyed without strictly managing the outer diameters of the first and second platen rollers 352 and 362. The looseness of the thermal recording paper P generated during the reverse conveyance can also be eliminated.

Sixth Embodiment

Figure 13:
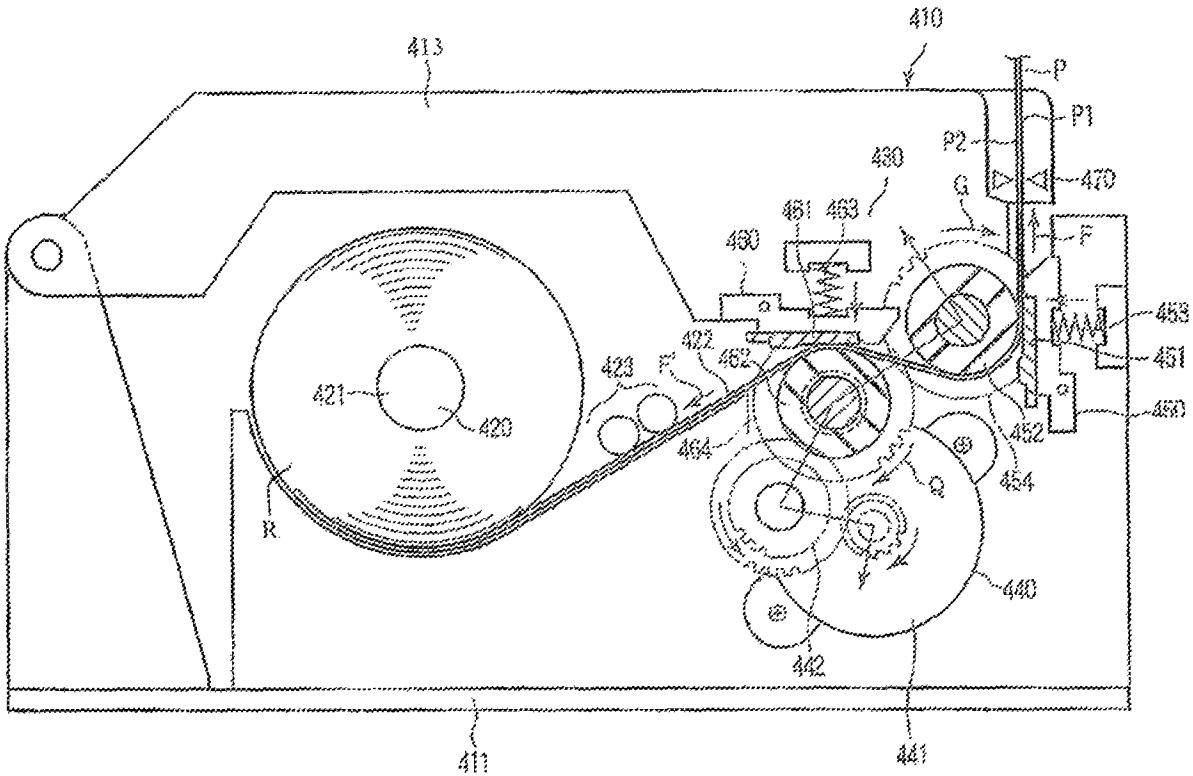
FIG. 13 is a longitudinal sectional view schematically showing a double-side printing thermal printer according to a sixth embodiment of the invention.
Figure 14:
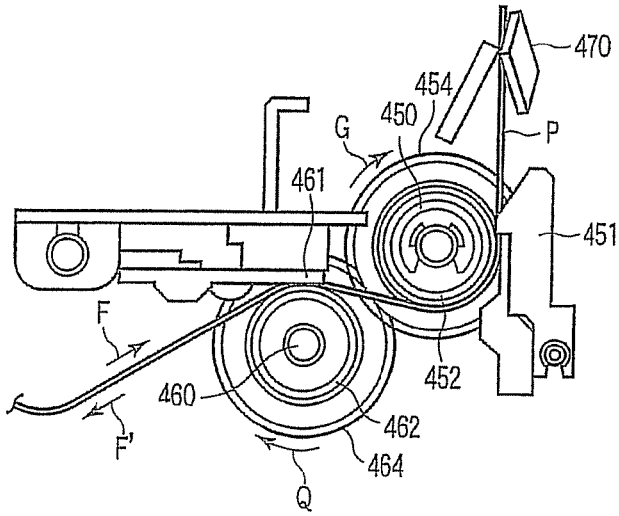
FIG. 14 is a side view showing a main part of a printing mechanism incorporated into the double-side printing thermal printer of the sixth embodiment.

FIG. 13 is a longitudinal sectional view schematically showing a double-side printing thermal printer 410 according to a sixth embodiment of the invention, and FIG. 14 is a side view showing a main part of a printing mechanism 430 incorporated into the double-side printing thermal printer 410. In FIG. 13, the letter P designates double-sided thermal recording paper.

The double-side printing thermal printer 410 includes a chassis 411, a chassis body 412, and an openable cap 413. Each mechanism is accommodated in the chassis body 412, and the openable cap 413 is provided while being openable with respect to the chassis body 412.

A thermal recording paper supply unit 420 and the printing mechanism 430 are accommodated in the chassis 411. The thermal recording paper supply unit 420 rotatably supports the thermal recording paper roller R about which the thermal recording paper P is wound, and the thermal recording paper supply unit 420 supplies the thermal recording paper P. The printing mechanism 430 carries out the printing on the supplied thermal recording paper P.

The thermal recording paper supply unit 420 includes a retaining unit 421 and a feed mechanism 423. The retaining unit 421 retains the thermal recording paper roller R. The feed mechanism 423 conveys the thermal recording paper P from the retaining unit 421 to the printing mechanism 430 along a paper conveyance path 422.

The printing mechanism 430 includes a drive mechanism 440, a first printing unit 450, a second printing unit 460, and a cutting mechanism 470. The first printing unit 450, the second printing unit 460, and the cutting mechanism 470 are provided along the paper conveyance path 422.

The drive mechanism 440 includes a drive motor 441 and a gear mechanism 442 which transmits the torque generated by the drive motor 441 to each unit.

The first printing unit 450 includes a first thermal head 451, a first platen roller 452, a spring 453, and a one-way gear 454. The first thermal head 451 is arranged so as to face one side (first surface side) orthogonal to a direction in which the paper conveyance path 422 is extended. The first platen roller 452 is arranged so as to face the first thermal head 451 across the paper conveyance path 422. The spring 453 biases the first thermal head 451 toward the side of the first platen roller 452. The one-way gear 454 selectively transmits the torque from the gear mechanism 442 to the first platen roller 452. The one-way gear 454 is freely rotated (free state) to disconnect the torque when the first platen roller 452 is rotated in the reverse conveyance direction (arrow G in FIGS. 13 and 14) of the thermal recording paper P, and the one-way gear 454 engages the gear mechanism 442 (locked state) to transmit the torque when the first platen roller 452 is rotated in the conveyance direction (arrow F in FIGS. 13 and 14) of the thermal recording paper P.

The second printing unit 460 includes a second thermal head 461, a second platen roller 462, a spring 463, and a one-way gear (selective torque transmission mechanism) 464. The second thermal head 461 is arranged so as to face the other side (second surface side) orthogonal to the direction in which the paper conveyance path 422 is extended. The second platen roller 462 is arranged so as to face the second thermal head 461 across the paper conveyance path 422. The spring 463 biases the second thermal head 461 toward the side of the second platen roller 462. The one-way gear 464 selectively transmits the torque from the gear mechanism 442 to the second platen roller 462. The one-way gear 464 is freely rotated (free state) to disconnect the torque when the second platen roller 462 is rotated in the conveyance direction (arrow Q in FIGS. 13 and 14) of the thermal recording paper P, and the one-way gear 464 engages the gear mechanism 442 (locked state) to transmit the torque when the second platen roller 462 is rotated in the conveyance direction (arrow F' in FIGS. 13 and 14) of the thermal recording paper P.

The double-side printing thermal printer 410 having the above configuration carries out the printing as follows. When a printing command is inputted from the outside, the drive motor 441 is rotated in a predetermined direction. The rotation of the drive motor 441 drives the feed mechanism 423 through the gear mechanism 442 to drive the thermal recording paper P toward the discharge direction.

The gear mechanism 442 further rotates the first platen roller 452 in the conveyance direction of the thermal recording paper P. On the other hand, the second platen roller 462 is only driven by the thermal recording paper P because the torque is disconnected by the one-way gear 464. Therefore, the tensile force is applied to the thermal recording paper P by the first platen roller 452, and the thermal recording paper P is conveyed toward the discharge direction irrespective of the outer-diameter sizes of the first and second platen rollers 452 and 462 while a constant tension is always maintained.

In this state, the thermal recording paper P is conveyed to the second printing unit 460. The second printing unit 460 starts the printing onto the second surface P2 of the thermal recording paper P. When the thermal recording paper P reaches the first printing unit 450, the first printing unit 450 starts the printing onto the first surface P1 of the thermal recording paper P.

When the thermal recording paper P is reversely conveyed due to the positioning of the printing position and the like, the gear mechanism 442 rotates the second platen roller 462 so as to reversely convey the thermal recording paper P. On the other hand, the first platen roller 452 is only driven by the thermal recording paper P because the torque is disconnected by the one-way gear 454. Therefore, the tensile force is applied to the thermal recording paper P by the second platen roller 462, and the thermal recording paper P is conveyed toward the reverse conveyance direction irrespective of the outer-diameter sizes of the first and second platen rollers 452 and 462 while a constant tension is always maintained.

When the printing is completed to both sides of the thermal recording paper P, the thermal recording paper P is delivered to a cutting mechanism 470, and the thermal recording paper P is cut by the cutting mechanism 470.

Thus, the double-side printing thermal printer 410 of the sixth embodiment can carry out the printing onto both sides of the thermal recording paper P. Furthermore, when the first and second platen rollers 452 and 462 are driven by the same drive motor 441, the thermal recording paper P can smoothly be conveyed without strictly managing the outer diameters of the first and second platen rollers 452 and 462.

Seventh Embodiment

Figure 15:
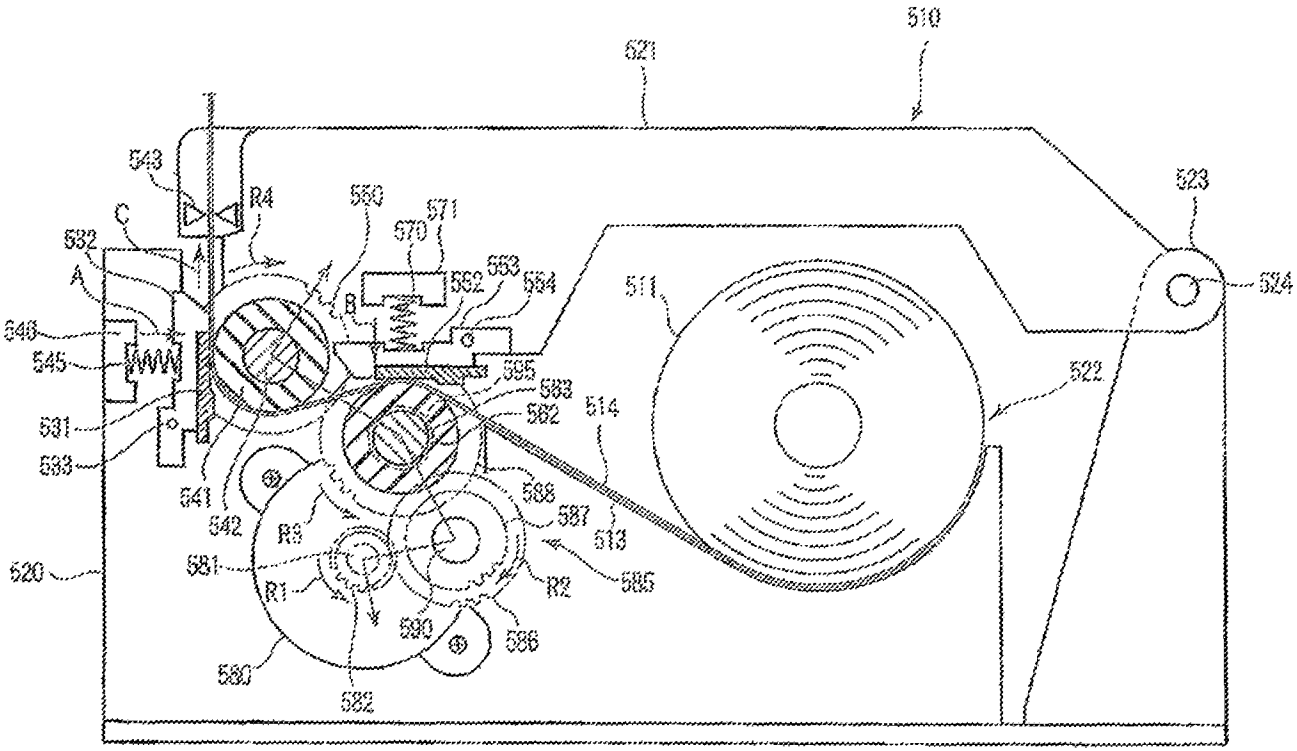
FIG. 15 is a side view schematically showing an inside of a thermal printer according to a seventh embodiment of the invention.

A thermal printer according to a seventh embodiment of the invention will be described below with reference to FIGS. 15 to 18. FIG. 15 schematically shows an inside of a thermal printer 510. The thermal printer 510 can carry out printing to both surfaces of double-sided thermal recording paper 511. For example, the thermal printer 510 can be used in a cash register of a store.

Figure 16:
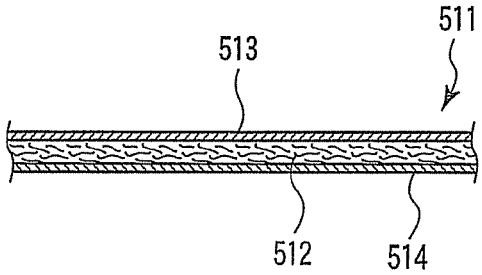
FIG. 16 is a sectional view schematically showing double-sided thermal recording paper.

As shown in FIG. 16, the double-sided thermal recording paper 511 includes a base paper 512 and heat-sensitive layers 513 and 514 which are formed on both the surfaces of the base paper 512. The first heat-sensitive layer 513 is formed on one side (for example, surface) of the base paper 512, and the second heat-sensitive layer 514 is formed on the other side (for example, backside) of the base paper 512. Each of the heat-sensitive layers 513 and 514 is made of a material which develops a desired color such as black and red when heated to a predetermined temperature or more. As shown in FIG. 15, the thermal recording paper 511 is wound in a roll shape such that the first heat-sensitive layer 513 faces the inside.

Figure 18:
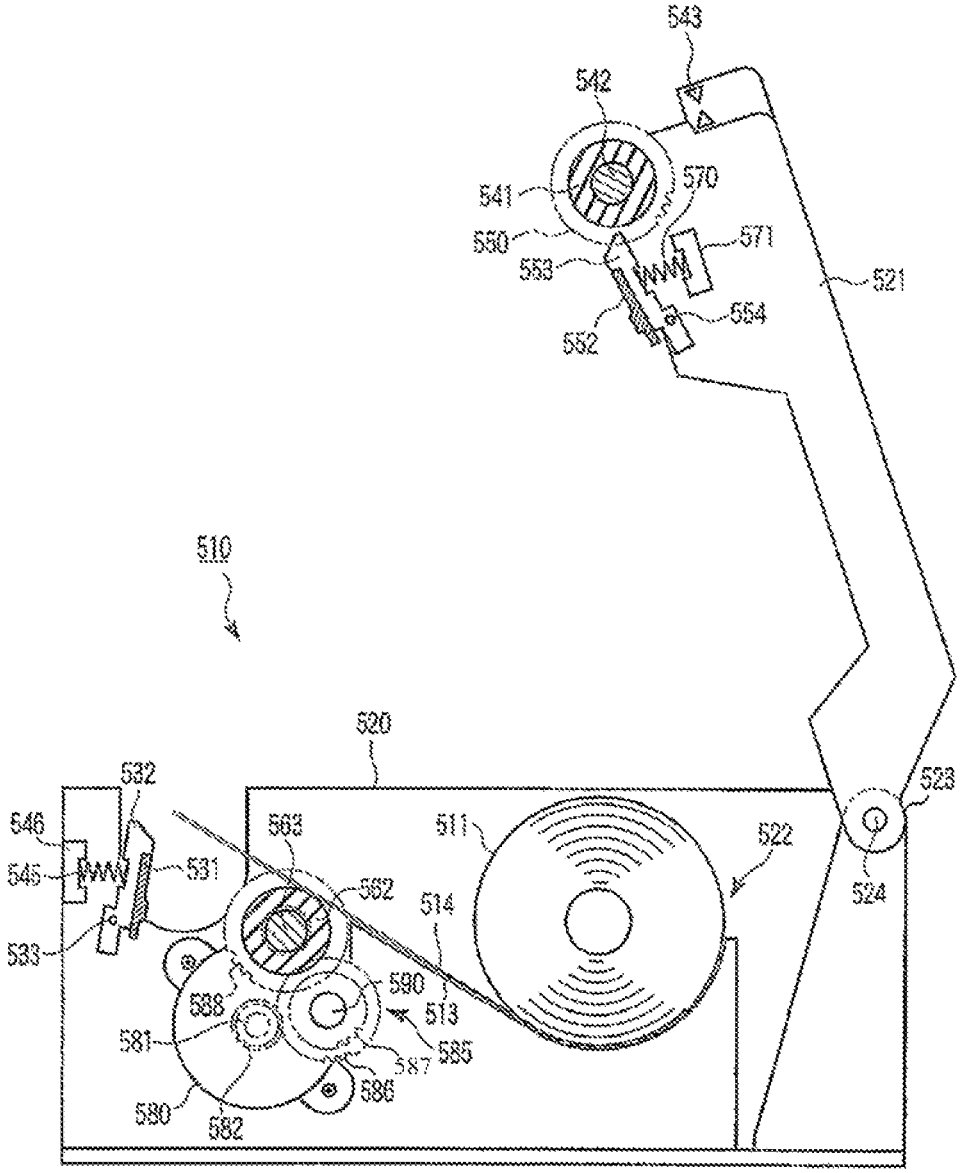
FIG. 18 is a side view schematically showing a state in which a cover of the thermal printer of FIG. 15 is opened.

The thermal printer 510 includes a printer body 520 and an openable cover 521. A paper storage portion 522 in which the roll thermal recording paper 511 is stored is provided in the printer body 520. The cover 521 can be opened upward while rotated about a shaft 524 of a hinge portion 523 provided in the rear portion of the printer body 520. The upper surface side of the printer body 520 is opened while the cover 521 is opened. FIG. 15 shows a state in which the cover 521 is closed, and FIG. 18 shows a state in which the cover 521 is opened.

A first thermal head 531 is provided in the printer body 520. The first thermal head 531 is arranged so as to come into contact with one of the surfaces of the thermal recording paper 511, i.e., the first heat-sensitive layer 513. The first thermal head 531 is attached to a heat sink 532 which is a radiator. The first thermal head 531 and the heat sink 532 can be rotated about a shaft 533.

On the side of the cover 521, a first platen roller 541 is provided at a position corresponding to the first thermal head 531. As shown in FIG. 15, when the cover 521 is closed, the first platen roller 541 faces the first thermal head 531 while the thermal recording paper 511 is nipped between the first platen roller 541 and the first thermal head 531.

The first platen roller 541 is made of an elastic rubber such as NBR (nitrile rubber) having a friction coefficient larger than that of metal. The first platen roller 541 is formed in a cylindrical shape, and can be rotated about a horizontally-extended platen roller shaft 542 while being integral with the platen roller shaft 542. A cutter mechanism 543 used to cut the thermal recording paper 511 is provided above the first platen roller 541.

As shown in FIG. 15, the first thermal head 531 is arranged in a longitudinally-facing (substantially vertical) attitude on the side of the first platen roller 541. The front end portion of the roll thermal recording paper 511 stored in the paper storage portion 522 passes upwardly between the first thermal head 531 and the first platen roller 541 in the vertical direction, and the roll thermal recording paper 511 is discharged upward after passing through the cutter mechanism 543.

First biasing means 545 is provided on the backside of the first thermal head 531. A spring member such as a helical compression spring and a torsion spring can be cited as an example of the first biasing means 545. The first biasing means 545 is arranged in the compressed state between the heat sink 532 and a spring seat 546 provided in the printer body 520. The first biasing means 545 compresses the first thermal head 531 toward the first platen roller 541 in the direction of the arrow A in FIG. 15.

Figure 17:
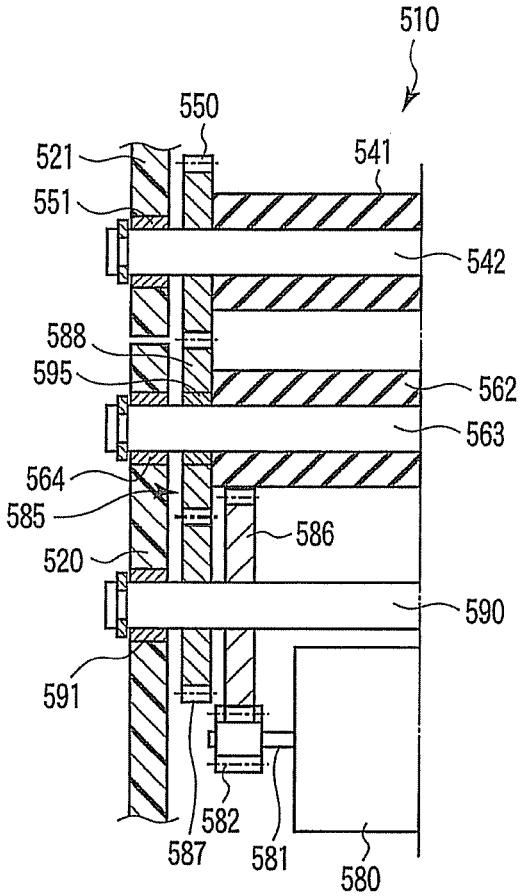
FIG. 17 is a sectional view showing a part of the thermal printer taken on line F3-F3 of FIG. 15.

As shown in FIG. 17, a platen roller gear 550 is provided adjacent to the first platen roller 541. The platen roller gear 550 is fixed to the platen roller shaft 542, and is rotated while being integral with the first platen roller 541. The platen roller shaft 542 is journaled in a pair of bearings 551 (only one is shown in FIG. 17) provided in the cover 521.

A second thermal head 552 is provided in the cover 521. The second thermal head 552 is arranged on the upstream side of the first thermal head 531 in the feed direction of the thermal recording paper 511. The second thermal head 552 is arranged so as to come into contact with the other surfaces of the thermal recording paper 511, i.e., the second heat-sensitive layer 514. The second thermal head 552 is attached to a heat sink 553 which is a radiator. The second thermal head 552 and the heat sink 553 can be rotated about a shaft 554.

A second platen roller 562 is provided at a position corresponding to the second thermal head 552 in the printer body 520. As shown in FIG. 15, when the cover 521 is closed, the second platen roller 562 faces the second thermal head 552 while the thermal recording paper 511 is nipped between the second platen roller 562 and the second thermal head 552.

The second platen roller 562 is made of an elastic rubber such as NBR (nitrile rubber) having a friction coefficient larger than that of metal. The second platen roller 562 is formed in a cylindrical shape, and can be rotated about a horizontally-extended shaft 563 while being integral with the shaft 563. The shaft 563 is journaled in a pair of bearings 564 (only one is shown in FIG. 17) provided in the printer body 520.

Second biasing means 570 is provided on the backside of the second thermal head 552. A spring member such as a helical compression spring and a torsion spring can be cited as an example of the second biasing means 570. The second biasing means 570 is arranged in the compressed state between the heat sink 553 and a spring seat 571 provided in the cover 521. The second biasing means 570 compresses the second thermal head 552 toward the second platen roller 562 in the direction of the arrow B in FIG. 15.

A motor 580 is accommodated in the printer body 520. An output gear 582 is attached to a rotating shaft 581 of the motor 580. The rotation of the motor 580 (rotation of the output gear 582) is transmitted to the platen roller gear 550 through a power transmission mechanism 585. The power transmission mechanism 585 includes a reduction gear 586, a driving gear 587, and an idler gear 588. The reduction gear 586 engages the output gear 582, and the driving gear 587 is rotated while being integral with the reduction gear 586. The driving gear 587 and the idler gear 588 are attached to a horizontally-extended shaft 590. The shaft 590 is supported by a bearing 591 (shown in FIG. 17) while being rotatable with respect to the printer body 520.

The idler gear 588 is arranged so as to be coaxial with the second platen roller 562. That is, the idler gear 588 is arranged in the shaft 563 of the second platen roller 562 while being adjacent to the second platen roller 562. The idler gear 588 is supported by the shaft 563 of the second platen roller 562 through a bearing 595 so as to be relatively rotatable with respect to the second platen roller 562. The idler gear 588 engages both the driving gear 587 and the platen roller gear 550, and has a function of transmitting the rotation of the driving gear 587 to the platen roller gear 550.

As shown in FIG. 15, the second thermal head 552 is arranged in a laterally-facing (substantially horizontal) attitude on the second platen roller 562. The roll thermal recording paper 511 stored in the paper storage portion 522 passes horizontally between the second thermal head 552 and the second platen roller 562, and the roll thermal recording paper 511 is conveyed toward the first thermal head 531. That is, the thermal recording paper 511 passes horizontally by the first thermal head 531, the thermal recording paper 511 advances upward after the feed direction of the thermal recording paper 511 is changed by 90°. Then, the thermal recording paper 511 passes vertically by the second thermal head 531, and the thermal recording paper 511 is discharged upward.

Thus, in the thermal printer 510 of the seventh embodiment, the first thermal head 531, the second platen roller 562, the motor 580, and the idler gear 588 are arranged in the printer body 520. On the other hand, the first platen roller 541, the platen roller gear 550, and the second thermal head 552 are arranged on the side of the cover 521.

When the cover 521 is opened as shown in FIG. 18, the second thermal head 552 is separated from second platen roller 562 while the first thermal head 531 is separated from the first platen roller 541. The platen roller gear 550 is also separated from the idler gear 588 to open the upper surface side of the printer body 520. Therefore, the first and second thermal heads 531 and 552 and the first and second platen rollers 541 and 562 are completely exposed to the outside.

The action of the thermal printer 510 of the seventh embodiment will be described below. When the cover 521 is closed as shown in FIG. 15, the second thermal head 552 is pressed against the second platen roller 562 by the second biasing means 570 while the first thermal head 531 is pressed against the first platen roller 541 by the first biasing means 545, and the platen roller gear 550 engages the idler gear 588. The thermal recording paper 511 is caused to pass between the first thermal head 531 and the first platen roller 541 and between the second thermal head 552 and the second platen roller 562.

When the motor 580 is rotated, the output gear 582 is rotated in the direction of the arrow R1 in FIG. 15, which rotates the reduction gear 586 and the driving gear 587 in the direction of the arrow R2. The idler gear 588 is rotated in the direction of the arrow R3, which rotates the platen roller gear 550 and the first platen roller 541 in the R4 direction.

When the first platen roller 541 is rotated in the R4 direction, the thermal recording paper 511 is moved in the direction of the arrow C in FIG. 15 while being in contact with the first thermal head 531. Therefore, the first thermal head 531 can carry out the printing on the first heat-sensitive layer 513 of the thermal recording paper 511. The thermal recording paper 511 is horizontally moved toward the first thermal head 531 while being in contact with the second thermal head 552. Therefore, the second thermal head 552 can carry out the printing on the second heat-sensitive layer 514 of the thermal recording paper 511. The second platen roller 562 is never rotated by itself, but is driven according to the movement of the thermal recording paper 511.

Thus, when the first platen roller 541 is rotated in the direction of the arrow R4, the thermal recording paper 511 is drawn toward the direction of the arrow C from a gap between the first thermal head 531 and the first platen roller 541. At the same time, the thermal recording paper 511 is moved toward the first thermal head 531 from the gap between the second thermal head 552 and the second platen roller 562. At this point, because the frictional force is generated between the thermal recording paper 511 and the second thermal head 552, the tension is imparted to the thermal recording paper 511 between the first thermal head 531 and the second thermal head 552.

Therefore, because the proper tension can be imparted to the thermal recording paper 511, the high-quality double-side printing can be simultaneously be performed on the thermal recording paper 511 using the first thermal head 531 and the second thermal head 552. A predetermined amount of the printed thermal recording paper 511 is delivered from the first thermal head 531 by the rotation of the motor 580, and the thermal recording paper 511 is cut by a cutter mechanism 543.

When the cover 521 is opened as shown in FIG. 18, the second thermal head 552 is separated from the second platen roller 562 while the first thermal head 531 is separated from the first platen roller 541, and the platen roller gear 550 is separated from the idler gear 588. In the opened state, the upper surface side of the printer body 520 is opened, and the first and second thermal heads 531 and 552 and the first and second platen rollers 541 and 562 are completely exposed to the outside. Accordingly, the exchange and replenishment of the thermal recording paper 511 or the troubleshooting at the time of paper jam can easily be performed.

According to the thermal printer 510 of the seventh embodiment, the proper tension can be imparted between the first and second platen rollers 541 and 562 without being influenced by the outer diameters of the first and second platen rollers 541 and 562. Therefore, the looseness of the thermal recording paper 511 and the excessive tension can be avoided during the printing, and the high-quality double-side printing can simultaneously be done by the pair of thermal heads 531 and 552 based on the feed speed of the first platen roller 541.

The thermal printer 510 of the seventh embodiment has the simple configuration compared with the conventional apparatus in which the high-accuracy management is required for the feed speeds of the first and second platen rollers. In the seventh embodiment, the one motor 580 is used as the drive source, and the power transmission mechanism 585 from the rotating shaft 581 to the first platen roller 541 becomes simple and compact.

The thermal recording paper 511 passes horizontally by the first thermal head 531 having the substantially horizontal attitude, and advances upward after the feed direction is changed by 90° at the first platen roller 541. Then, the thermal recording paper 511 passes by the second thermal head 552 having the substantially vertical attitude, and is discharged upward. Because the conveyance path of the thermal recording paper 511 is formed as described above, the distance can be shortened between the first thermal head 531 and the second thermal head 552, and the compact thermal heads 531 and 552 can be formed. This enables the double-side printing thermal printer 510 to be further miniaturized.

Eighth Embodiment

Figure 19:
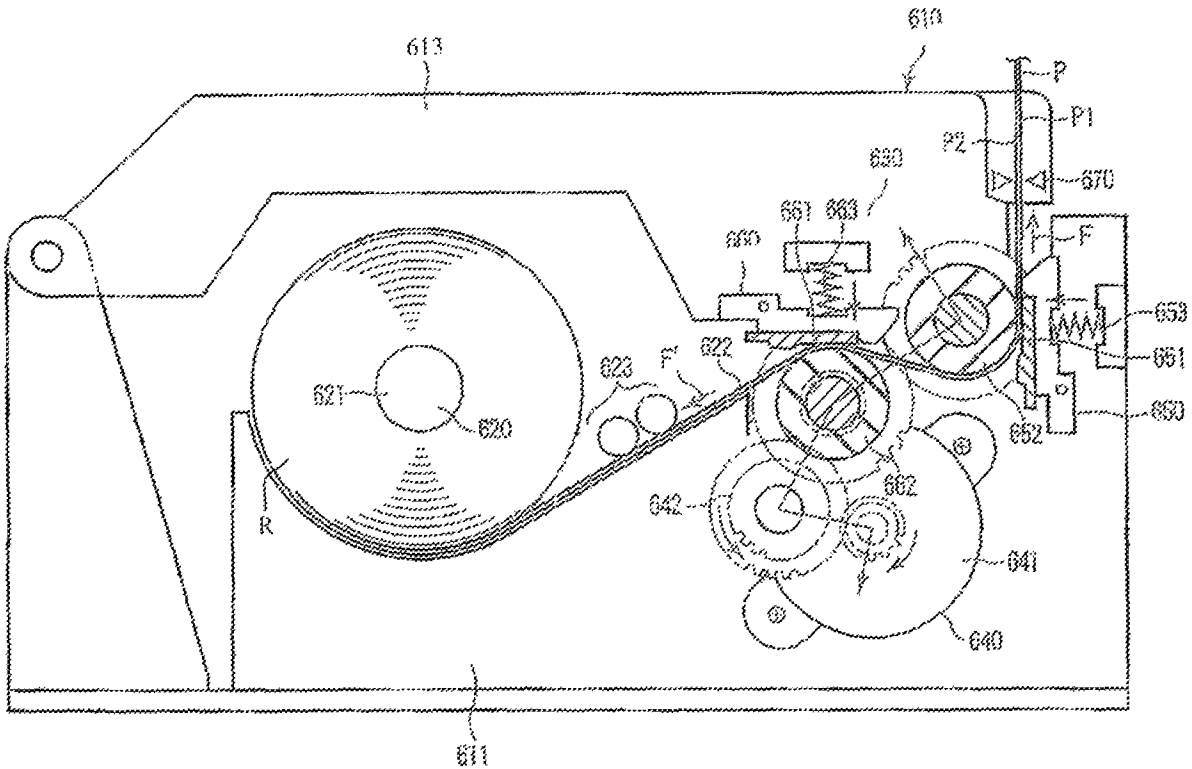
FIG. 19 is a longitudinal sectional view schematically showing a double-side printing thermal printer according to an eighth embodiment of the invention.
Figure 20:
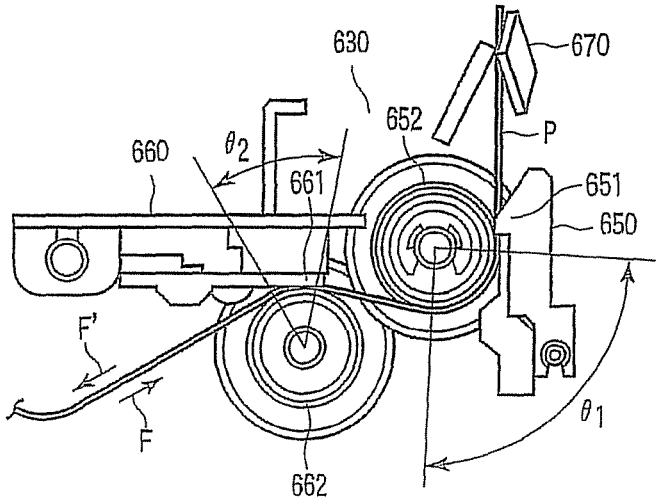
FIG. 20 is a side view showing a main part of a printing mechanism incorporated into the double-side printing thermal printer of the eighth embodiment.

FIG. 19 is a longitudinal sectional view schematically showing a double-side printing thermal printer 610 according to an eighth embodiment of the invention, and FIG. 20 is a side view showing a main part of a printing mechanism 630 incorporated into the double-side printing thermal printer 610. In the figures, the letter P designates double-sided thermal recording paper.

The double-side printing thermal printer 610 includes a chassis 611, a chassis body 612, and an openable cap 613. Each mechanism is accommodated in the chassis body 612, and the openable cap 613 is provided while being openable with respect to the chassis body 612.

A thermal recording paper supply unit 620 and the printing mechanism 630 are accommodated in the chassis 611. The thermal recording paper supply unit 620 rotatably supports the thermal recording paper roller R about which the thermal recording paper P is wound, and the thermal recording paper supply unit 620 supplies the thermal recording paper P. The printing mechanism 630 carries out the printing on the supplied thermal recording paper P.

The thermal recording paper supply unit 620 includes a retaining unit 621 and a feed mechanism 623. The retaining unit 621 retains the thermal recording paper roller R. The feed mechanism 623 conveys the thermal recording paper P from the retaining unit 621 to the printing mechanism 630 along a paper conveyance path 622. In the figures, the letter F designates a conveyance direction and the letter F' designates a reverse conveyance direction.

The printing mechanism 630 includes a drive mechanism 640, a first printing unit 650, a second printing unit 660, and a cutting mechanism 670. The first printing unit 650, the second printing unit 660, and the cutting mechanism 670 are provided along the paper conveyance path 622.

The drive mechanism 640 includes a drive motor 641 and a gear mechanism 642 which transmits the torque generated by the drive motor 641 to each unit.

The first printing unit 650 includes a first thermal head 651, a first platen roller 652, and a spring 653. The first thermal head 651 is arranged so as to face one side (first surface side) orthogonal to the direction in which the paper conveyance path 622 is extended. The first platen roller 652 is arranged so as to face the first thermal head 651 across the paper conveyance path 622. The spring 653 biases the first thermal head 651 toward the side of the first platen roller 652. The first platen roller 652 is driven by the gear mechanism 642.

The second printing unit 660 includes a second thermal head 661, a second platen roller 662, and a spring 663. The second thermal head 661 is arranged so as to face the other side (second surface side) orthogonal to the direction in which the paper conveyance path 622 is extended. The second platen roller 662 is arranged so as to face the second thermal head 661 across the paper conveyance path 622. The spring 663 biases the second thermal head 661 toward the side of the second platen roller 662. The second platen roller 662 is driven by the gear mechanism 642.

A first entrained angle θ1 of the thermal recording paper P about the first platen roller 652 is set larger than a second entrained angle θ2 about the second platen roller 662, so that the driving force from the first platen roller 651 to the thermal recording paper P becomes larger than the driving force from the second platen roller 662 to the thermal recording paper P.

On the other hand, the circumferential velocity of the first platen roller 652 is set so as to be faster than that of the second platen roller 662. Specifically, the gear mechanism 642 is set such that the first platen roller 652 is larger than the second platen roller 662 in the outer diameter while the first platen roller 652 is equal to the second platen roller 662 in the angular velocity.

In the above example, the first and second platen rollers 652 and 662 have the same angular velocity. However, the eighth embodiment can be applied even if the first and second platen rollers 652 and 662 have the different angular velocities. That is, it is necessary that a product of the rotation angle and outer diameter of the first platen roller 652 be larger than a product of the rotation angle and outer diameter of the second platen roller 662.

The double-side printing thermal printer 610 having the above configuration carries out the printing as follows. When a printing command is inputted from the outside, the drive motor 641 is rotated in a predetermined direction. The rotation of the drive motor 641 drives the feed mechanism 623 through the gear mechanism 642 to drive the thermal recording paper P toward the discharge direction.

The gear mechanism 642 further rotates the first and second platen rollers 652 and 662 in the conveyance direction of the thermal recording paper P. As described above, the first platen roller 652 is faster than the second platen roller 662 in the circumferential velocity, and the first entrained angle θ1 of the thermal recording paper P about the first platen roller 652 is set larger than the second entrained angle θ2 about the second platen roller 662.

Therefore, the driving force is dominantly applied to the thermal recording paper P by the first platen roller 652 while the driving force of the second platen roller 662 becomes subsidiary. Furthermore, because the first platen roller 652 is faster than the second platen roller 662 in the circumferential velocity, the conveyance speed of the thermal recording paper P is substantially equal to the circumferential velocity of the first platen roller 652. Accordingly, the thermal recording paper P is conveyed while the tensile force is slightly generated in the thermal recording paper P between the first platen roller 652 and the second platen roller 662. When the tensile force applied to the thermal recording paper P becomes excessive, the thermal recording paper P slips on the second platen roller 662 due to the difference between the first entrained angle θ1 and the second entrained angle θ2, so that there is no risk of the breakage of the thermal recording paper P.

In this state, the thermal recording paper P is conveyed to the second printing unit 660. The second printing unit 660 starts the printing onto the second surface P2 of the thermal recording paper P. When the thermal recording paper P reaches the first printing unit 650, the first printing unit 650 starts the printing onto the first surface P1 of the thermal recording paper P.

When the thermal recording paper P is reversely conveyed due to the positioning of the printing position and the like, the first and second platen rollers 652 and 662 are reversely rotated. At this point, because the first platen roller 652 is faster than the second platen roller 662 in the circumferential velocity, the reverse conveyance amount of thermal recording paper P is hardly generated although the looseness is generated in the thermal recording paper P. Therefore, there is generated no practical problem.

When the printing is completed to both sides of the thermal recording paper P, the feed mechanism 623 delivers the thermal recording paper P to a cutting mechanism 670, and the thermal recording paper P is cut by the cutting mechanism 670.

Thus, the double-side printing thermal printer 610 of the eighth embodiment can carry out the printing onto both sides of the thermal recording paper P. Furthermore, when the first and second platen rollers 652 and 662 are driven by the same drive motor 641, the looseness of the thermal recording paper P can be eliminated by always applying the proper tensile force to the thermal recording paper P between the first platen roller 652 and the second platen roller 662.

Figure 21:
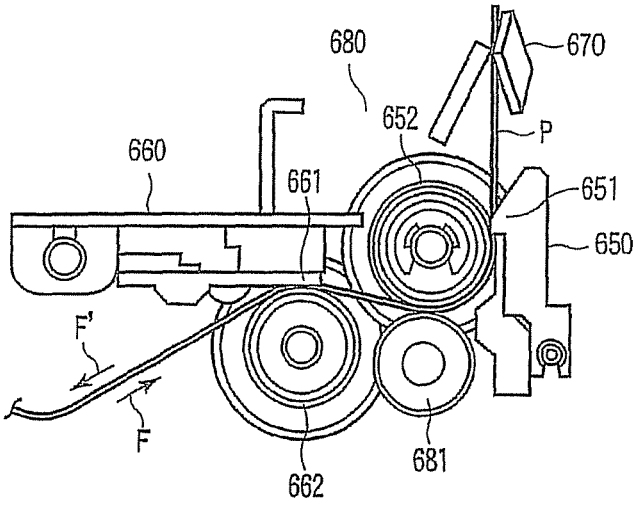
FIG. 21 is a side view showing a modification of the main part of the printing mechanism of the eighth embodiment.

FIG. 21 is a side view showing a printing mechanism 680 which is a modification of the printing mechanism 630. In FIG. 21, the same functional components as those of FIG. 20 are designated by the same numerals, and the detail description will be omitted.

The printing mechanism 680 includes a pinch roller 681 which biases the thermal recording paper P toward the side of the first platen roller 652. The printing mechanism 680 is arranged along the paper conveyance path 622 while being adjacent to the first thermal head 651. Therefore, the driving force applied to the thermal recording paper P from the first platen roller 651 becomes larger than the driving force applied to the thermal recording paper P from the second platen roller 662.

Therefore, the driving force is dominantly applied to the thermal recording paper P by the first platen roller 652 while the driving force of the second platen roller 662 becomes subsidiary. Furthermore, because the first platen roller 652 is faster than the second platen roller 662 in the circumferential velocity, the conveyance speed of the thermal recording paper P is substantially equal to the circumferential velocity of the first platen roller 652. Accordingly, the thermal recording paper P is conveyed while the tensile force is slightly generated in the thermal recording paper P between the first platen roller 652 and the second platen roller 662.

As described above, when the first and second platen rollers 652 and 662 are driven by the same drive motor 641, the tensile force is always applied to the thermal recording paper P between the first platen roller 652 and the second platen roller 662, so that the looseness of the thermal recording paper P can be eliminated.

In the printing mechanism 680, as with the printing mechanism 630, the first entrained angle θ1 of the thermal recording paper P about the first platen roller 652 is set larger than the second entrained angle θ2 about the second platen roller 662. Alternatively, the driving force applied to the thermal recording paper P from the first platen roller 651 may be set larger than the driving force applied to the thermal recording paper P from the second platen roller 662 only by the biasing force of the pinch roller 681.

Ninth Embodiment

Figure 22:
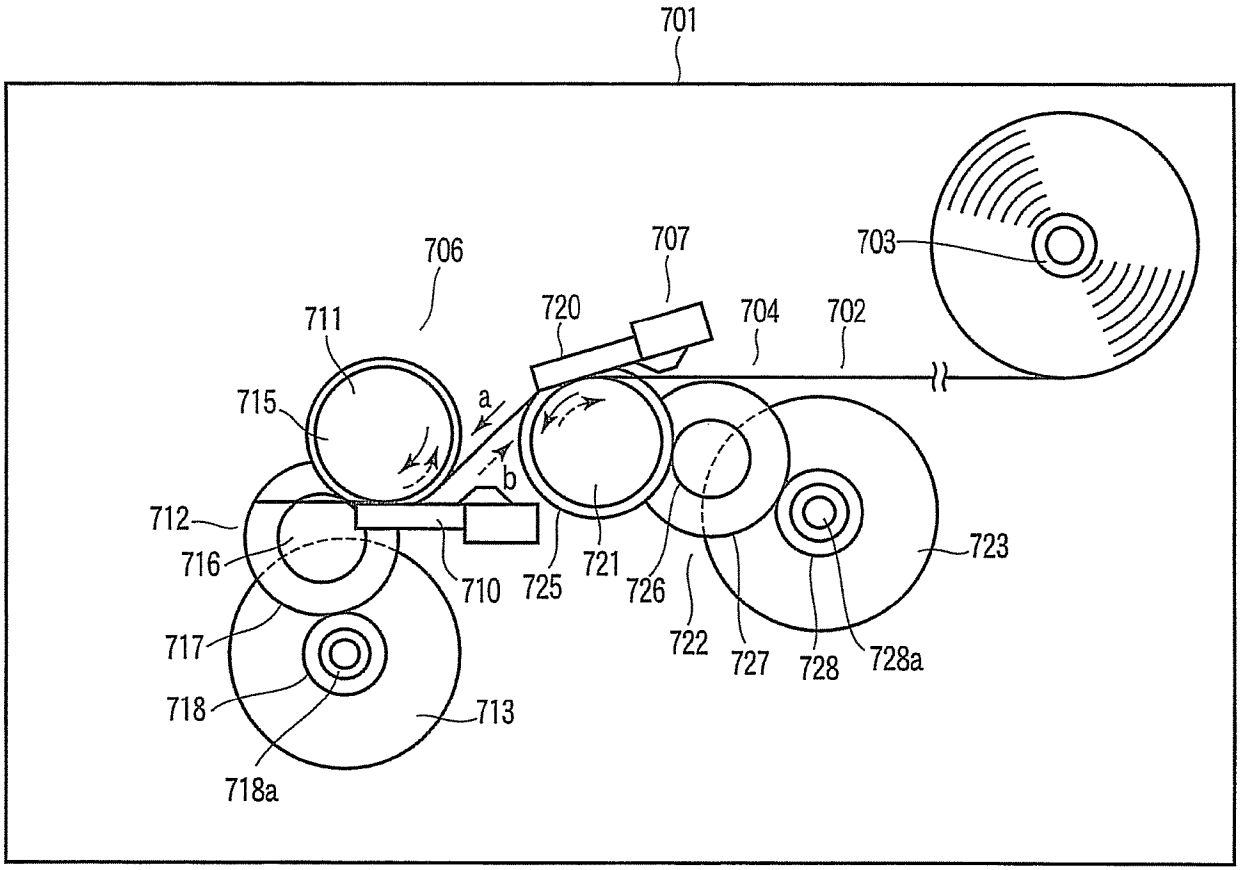
FIG. 22 shows a schematic configuration of a printing apparatus according to a ninth embodiment of the invention.

FIG. 22 shows a printing apparatus according to a ninth embodiment of the invention. The numeral 701 designates an apparatus body. A reel portion 703 is provided in the apparatus body 701 to supply both-sided thermal recording paper 702, and the paper 702 is drawn along a paper conveyance path 704. First and second printing units 706 and 707 are arranged in the paper conveyance path 704. The first printing unit 706 is located on the downstream side in the paper feed direction, and the second printing unit 707 is located on the upstream side in the paper feed direction.

The first printing unit 706 includes a first thermal head 710 which is a first printhead. A first platen roller 711 is provided on the first thermal head 710 through the paper conveyance path 704.

A first drive motor 713 which is a first drive source is connected to the first platen roller 711 through a first power transmission system 712. The first power transmission system 712 is a gear train including first to fourth gears 715 to 718, and the fourth gear (tension imparting means) 718 is a one-way gear including a first one-way clutch 718*a*.

The second printing unit 707 includes a second thermal head 720 which is a second printhead. A second platen roller 721 is provided beneath the second thermal head 720 through the paper conveyance path 704. A second drive motor 723 which is a second drive source is connected to the second platen roller 721 through a second power transmission system 722. The second power transmission system 722 is a gear train including fifth to eighth gears 725 to 728, and the eighth gear (tension imparting means) 728 is a one-way gear including a second one-way clutch 728*a*.

The first drive motor 713 is rotated when the paper 702 is fed in the normal direction (shown by arrow a), and the second drive motor 723 is rotated when the paper 702 is fed in the reverse direction (shown by arrow b). The second drive motor 723 is stopped when the first drive motor 713 is rotated, and the first drive motor 713 is stopped when the second drive motor 723 is rotated.

When the first drive motor 713 is rotated, the first one-way clutch 718*a* of the first power transmission system 712 connects the first drive motor 713 and the first power transmission system 712 to rotate the first platen roller 711 in the direction (first direction) shown by a solid arrow. When the first platen roller 711 is rotated in the direction (second direction opposite to first direction) shown by a dashed arrow, the first one-way clutch 718*a* disconnects the first power transmission system 712 and the first drive motor 713.

When the second drive motor 723 is rotated, the second one-way clutch 728*a* of the second power transmission system 722 connects the second drive motor 723 and the second power transmission system 722 to rotate the second platen roller 721 in the direction (first direction) shown by the dashed arrow. When the second platen roller 721 is rotated in the direction (second direction opposite to first direction) shown by the solid arrow, the second one-way clutch 728*a* disconnects the second power transmission system 722 and the second drive motor 723.

Figure 23:
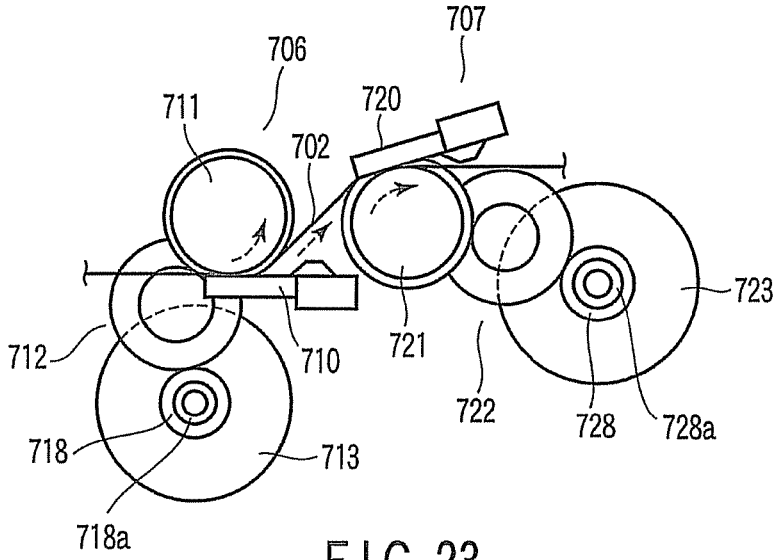
FIG. 23 shows a state in which the printing apparatus of FIG. 22 carries out printing on the other surface side of paper.

A printing operation of the printing apparatus having the above configuration will be described below. First the paper 702 is drawn from the reel portion 703. As shown in FIG. 23, the paper 702 is entrained between the first printing unit 706 and the second printing unit 707 to involve the paper 702 between the first and second thermal heads 710 and 720 and between the first and second platen rollers 711 and 721. In this state, the second drive motor 723 is reversely rotated to reversely feed the paper 702 by a displacement amount of the printing start position between the first and second printing units 706 and 707.

As shown in FIG. 23, when the second drive motor 723 is reversely rotated, the second platen roller 721 is rotated in the direction shown by the dashed arrow through the second power transmission system 722, and the paper 702 is reversely fed. At this point, the torque in the direction of the dashed arrow is imparted to the first platen roller 711 based on the reverse feed of the paper 702, and the torque is transmitted toward the first drive motor 713 through the first power transmission system 712. However, the torque is never transmitted to the first drive motor 713 because the first one-way clutch 718*a* disconnects the first power transmission system 712 and the first drive motor 713. Therefore, only the first platen roller 711 and the gear train of the first power transmission system 712 are rotated, and the force rotating the first platen roller 711 and the first power transmission system 712 is imparted to the paper 702 as a load, which imparts the tension to the paper 702.

When the paper 702 is reversely fed to reach a predetermined position, the rotation of the second drive motor 723 is stopped, and the second printing unit 707 starts the printing onto the other surface side of the paper 702 while the first drive motor 713 of the first printing unit 706 is rotated.

Figure 24:
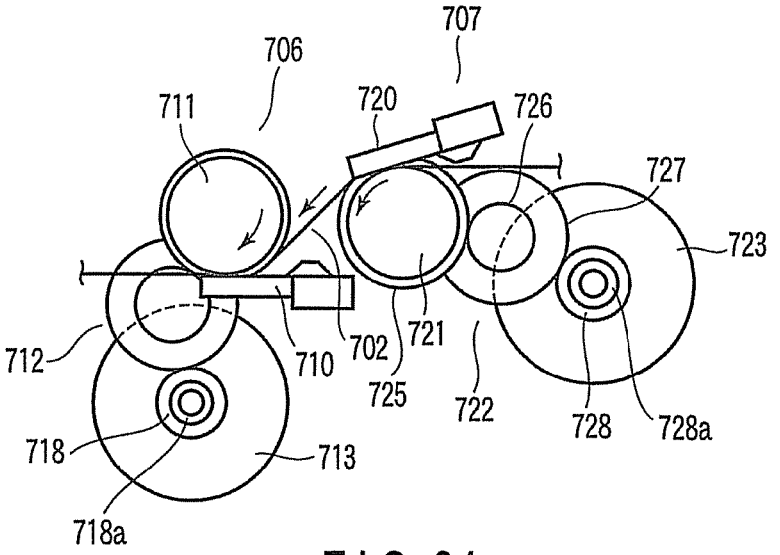
FIG. 24 shows a state in which the printing apparatus of FIG. 22 carries out printing on one surface side of paper.

As shown in FIG. 24, when the first drive motor 713 is rotated, the first platen roller 711 is rotated in the direction shown by the solid arrow through the first power transmission system 712, and the paper 702 is normally fed. When the printing start portion on the other surface side of the paper 702 reaches the first printing unit 706, the printing onto one surface side of the paper 702 is started by the first thermal head 710.

When the paper 702 is normally fed by the rotation of the first platen roller 711, the torque in the direction of the solid arrow is imparted to the second platen roller 721 through the paper 702, and the torque is transmitted toward the second drive motor 723 through the second power transmission system 722. However, the torque is never transmitted to the second drive motor 723 because the first one-way clutch 728*a* disconnects the second power transmission system 722 and the second drive motor 723. Therefore, only the second platen roller 721 and the gear train of the second power transmission system 722 are rotated, and the force rotating the second platen roller 721 and second power transmission system 722 is imparted to the paper 702 as the load, which imparts the tension to the paper 702.

According to the ninth embodiment, the tension can be imparted to the paper 702 not only in normally feeding the paper 702 but in reversely feeding the paper 702, the looseness of the paper 702 can be eliminated between the first platen roller 711 and the second platen roller 721, and the good paper feed can be realized.

Figure 25:
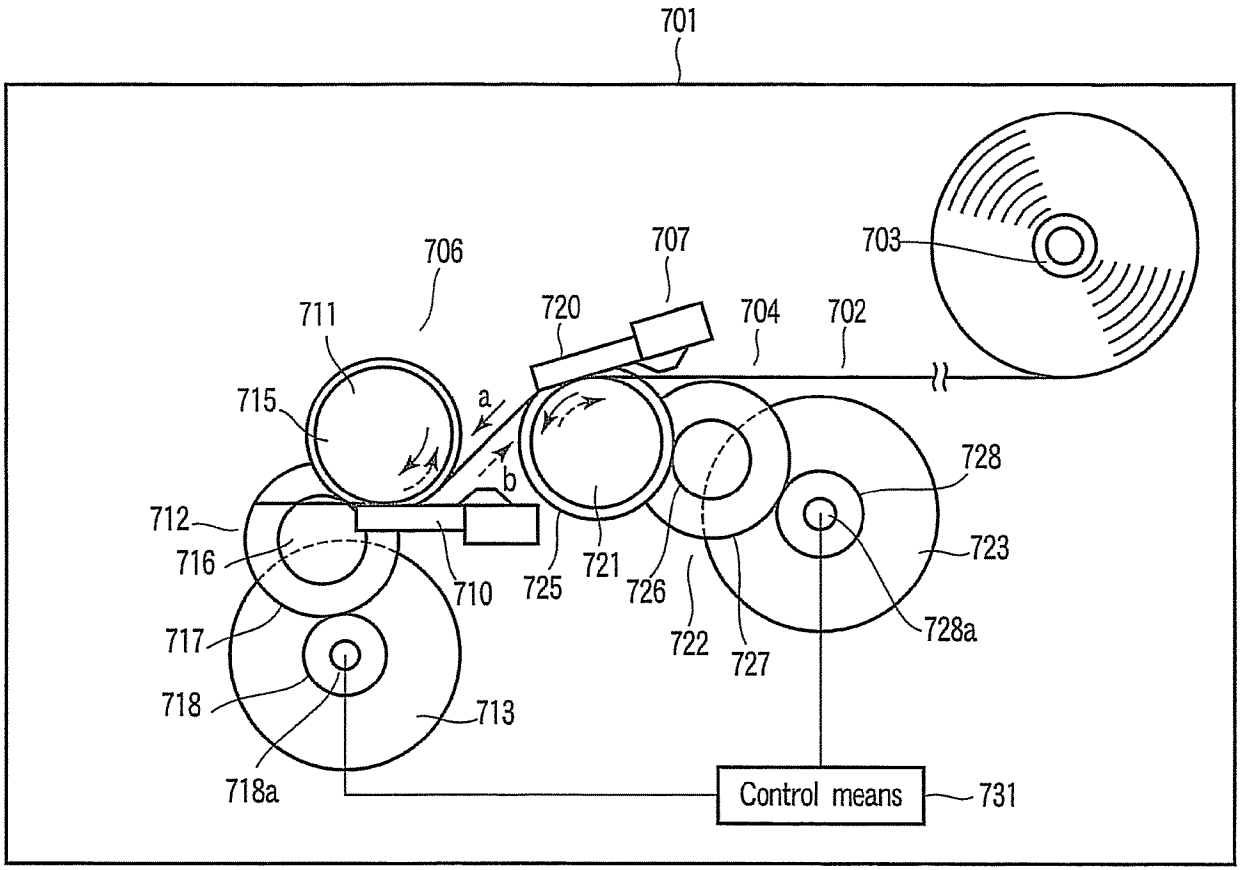
FIG. 25 shows a schematic configuration of a modification of the printing apparatus according to the ninth embodiment of the invention.

In the ninth embodiment, only one of the first and second drive motors 713 and 723 is rotated. The invention is not limited to the ninth embodiment. For example, as shown in FIG. 25, control means 731 may drive the first and second drive motors 713 and 723 in a synchronous manner without using the first and second one-way clutches 718*a* and 728*a*.

In this case, the rotating speed of the platen roller located on the downstream side in the paper conveyance direction is set faster than that of the platen roller located on the upstream side in the paper conveyance direction in order to increase the paper feed amount.

For example, the paper feed amount is increased by the first platen roller 711 when the paper 702 is normally fed, and the paper feed amount is increased by the second platen roller 721 when the paper 702 is reversely fed.

According to the method, the excessive tension is never imparted to the paper between the first platen roller 711 and the second platen roller 721, and the load on the drive motor located on the downstream side in the paper conveyance direction can be reduced.

Tenth Embodiment

Figure 26:
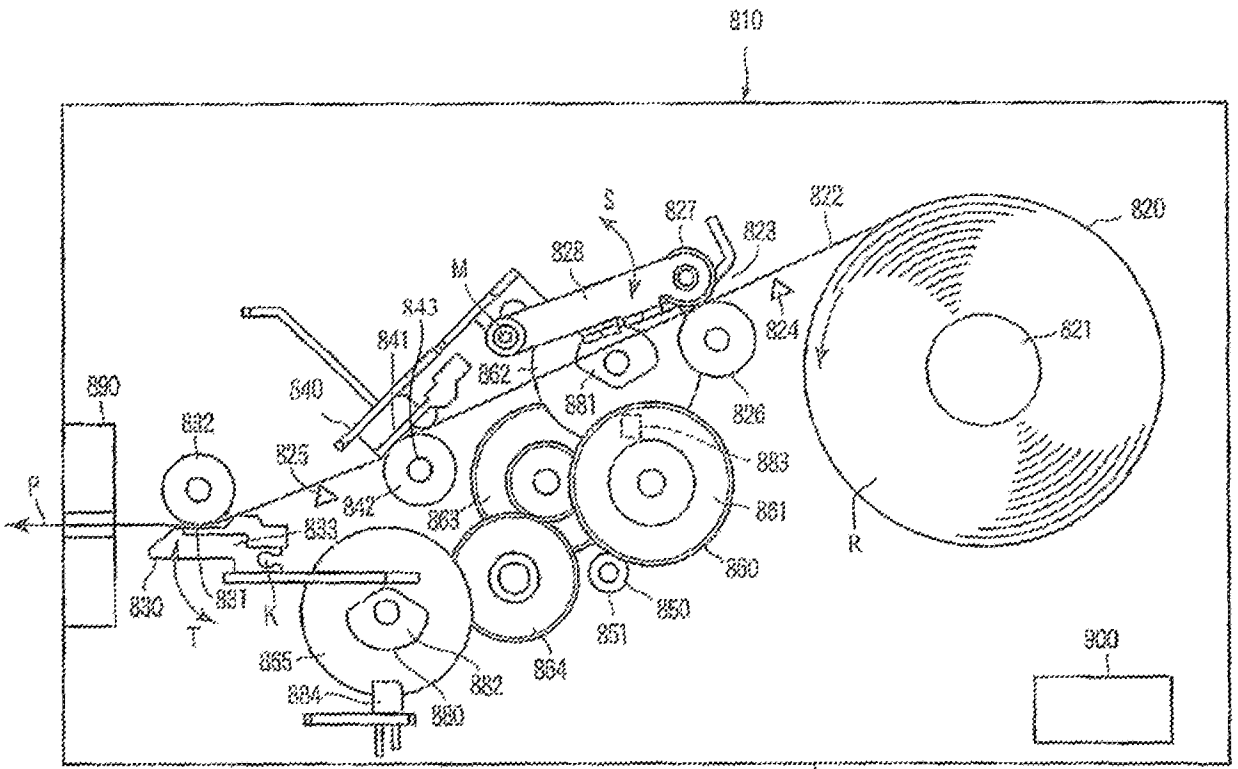
FIG. 26 is a side view showing a double-side printing thermal printer according to a tenth embodiment of the invention when viewed from one side.
Figure 27:
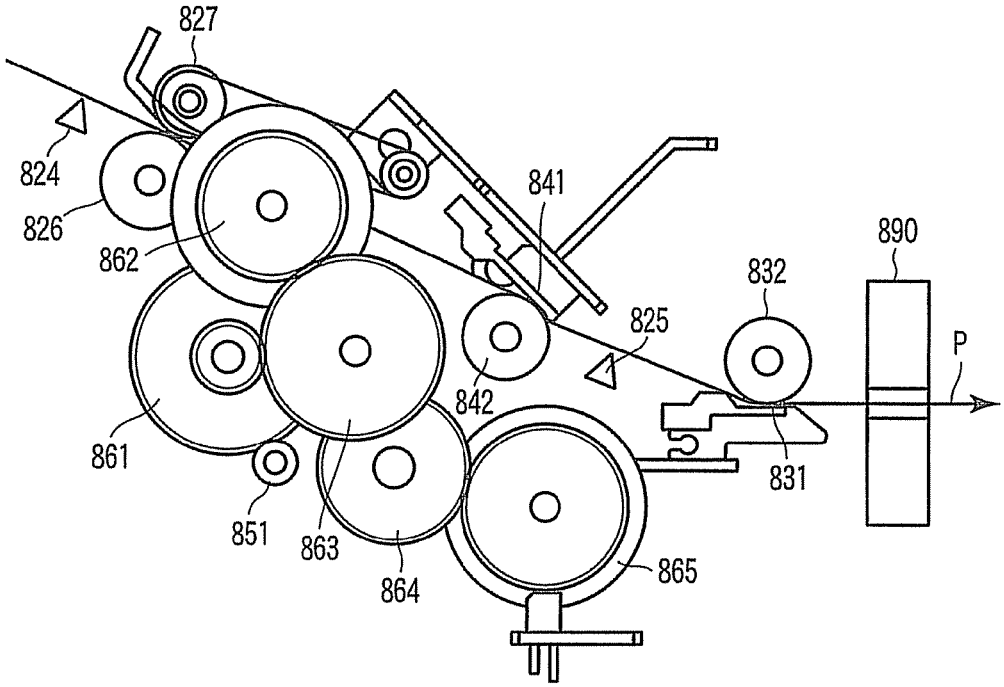
FIG. 27 is a side view showing the double-side printing thermal printer of the tenth embodiment when viewed from the other side.
Figure 28:
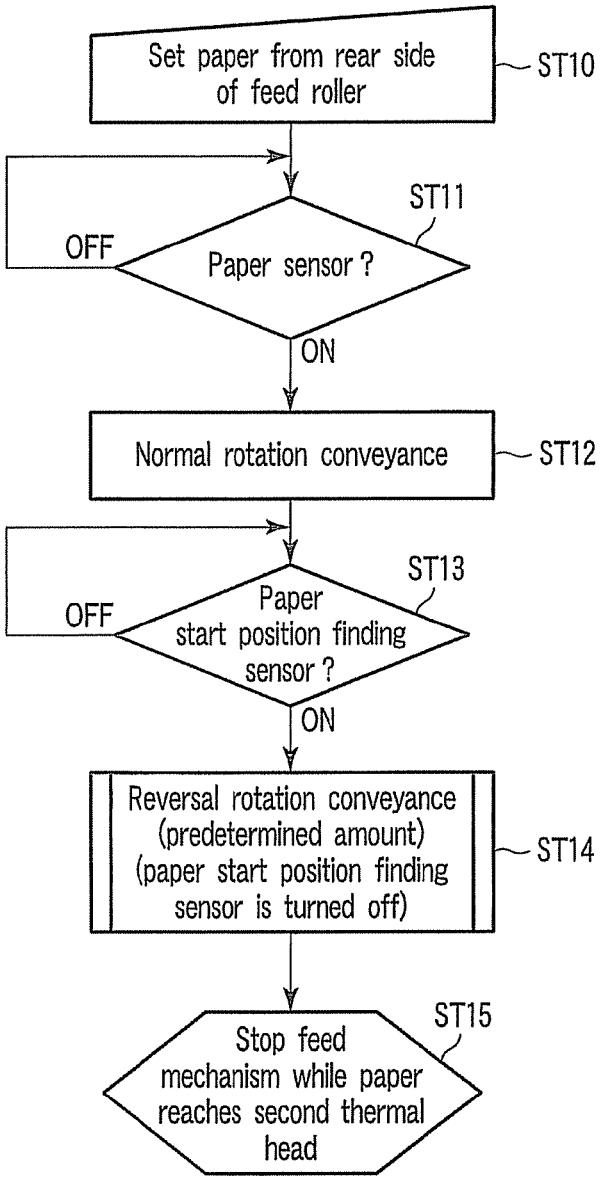
FIG. 28 is a flowchart showing an operation of the double-side printing thermal printer of the tenth embodiment.
Figure 29:
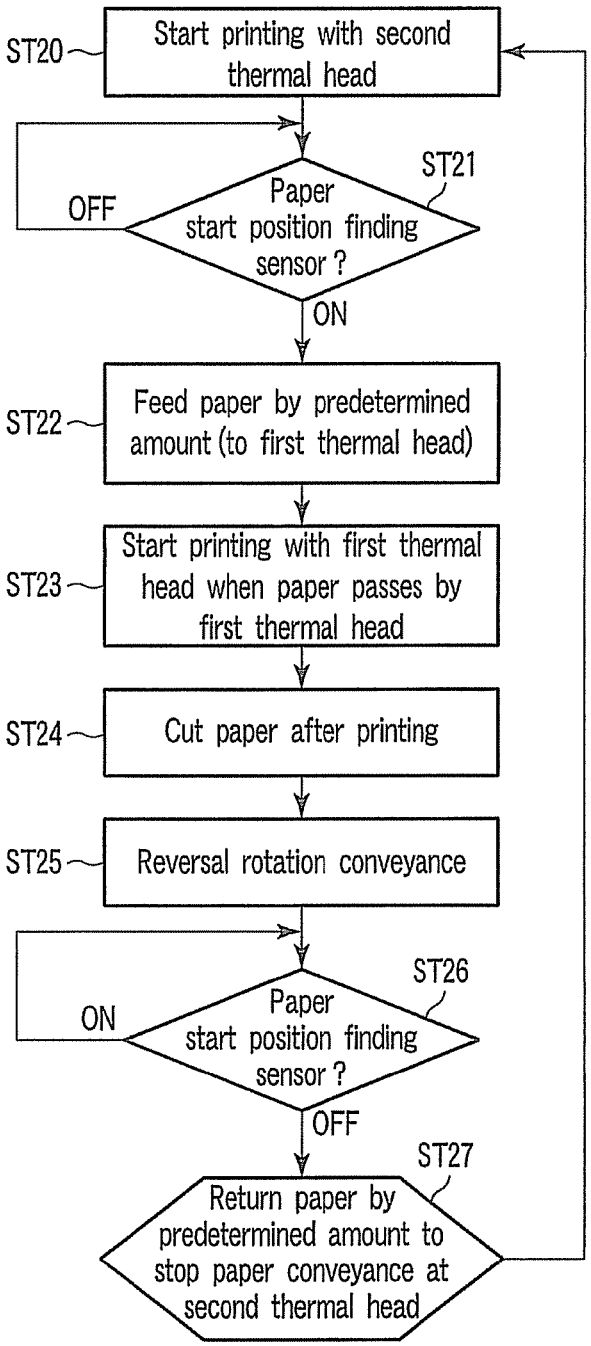
FIG. 29 is a flowchart showing an operation of the double-side printing thermal printer of the tenth embodiment.
Figure 30:
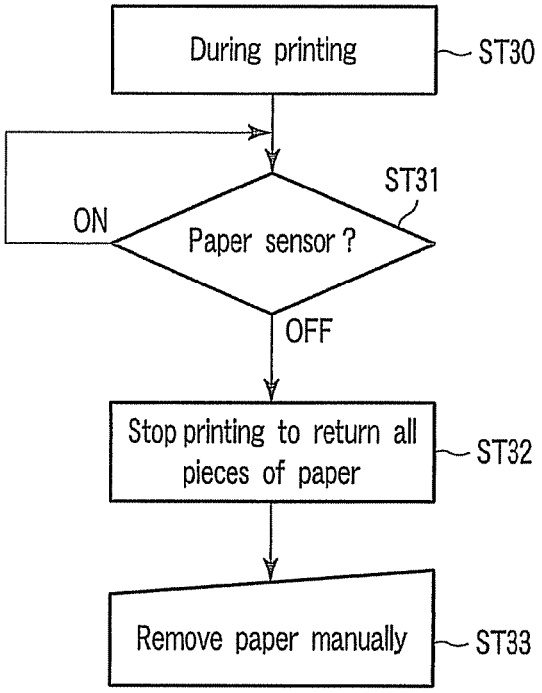
FIG. 30 is a flowchart showing an operation of the double-side printing thermal printer of the tenth embodiment.

FIG. 26 is a side view showing a double-side printing thermal printer 810 according to a tenth embodiment of the invention when viewed from one side, FIG. 27 is a side view showing the double-side printing thermal printer 810 when viewed from the other side, FIGS. 28 to 30 are flowcharts showing an operation of the double-side printing thermal printer 810, and FIG. 31 is an explanatory view showing a cam position of a cam mechanism 880 in each operation of the double-side printing thermal printer 810.

In the double-side printing thermal printer 810 of the tenth embodiment, a mechanism such as a pinch roller and a cam mechanism which automatically feeds the paper is added to perform autoloading.

As shown in FIG. 26, the double-side printing thermal printer 810 includes a chassis 811, a paper supply unit 820, a first printing unit 830, a second printing unit 840, a drive unit 850, a cutter device 890, and a control unit 900. The paper supply unit 820 is accommodated in the chassis 811, and the paper supply unit 820 supplies paper P such as the thermal recording paper. The second printing unit 840 is arranged between the first printing unit 830 and the paper supply unit 820. The drive unit 850 drives each unit. The cutter device 890 cuts the paper P on which the printing is already done. The control unit 900 performs control in cooperation with each unit.

The paper supply unit 820 includes a retaining unit 821, a feed mechanism (paper conveyance mechanism) 823, a paper sensor 824, a paper start position finding sensor 825. The retaining unit 821 retains the thermal recording paper roller R. The feed mechanism 823 conveys the paper P along a paper conveyance path 822 from the retaining unit 821 to the side of the cutter device 890. The paper sensor 824 is arranged in front of a pinch roller 827 described later. The paper start position finding sensor 825 is arranged between the first printing unit 830 and the second printing unit 840. Outputs of the paper sensor 824 and the paper start position finding sensor 825 are inputted to the control unit 900 to determine operating timing of each unit.

The feed mechanism 823 includes a feed roller 826 and the cylindrical pinch roller 827. The pinch roller 827 is provided so as to sandwich the paper conveyance path 822 between the pinch roller 827 and the feed roller 826. The pinch roller 827 is provided in a roller arm (pinch roller contacting and separating mechanism) 828, and the pinch roller 827 can be brought into contact with and separated from the feed roller 826 by the operation of a pinch roller cam 881. The roller arm 828 is attached while being swingable in the direction of an arrow S in FIG. 26 about a pinch roller crankshaft M in the direction perpendicular to a plane.

In the first printing unit 830, a first thermal head 831 and a first platen roller 832 are arranged while facing each other so as to sandwich the paper conveyance path 822. The first thermal head 831 is provided in a head arm (thermal head contacting and separating mechanism) 833, and the first thermal head 831 can be brought into contact with and separated from the first platen roller 832 by the operation of a thermal head cam 882. The head arm 833 is attached while being swingable in the direction of an arrow T in FIG. 26 about a first thermal head crankshaft K in the direction perpendicular to the plane.

In the second printing unit 840, a second thermal head 841 and a second platen roller 842 are arranged while facing each other so as to sandwich the paper conveyance path 822. The second platen roller 842 includes a one-way clutch (selective torque transmission mechanism) 843 in which the coupling to the gear mechanism 860 is released when the second platen roller 842 is rotated in the reverse conveyance direction.

The first platen roller 832, the second platen roller 842, and the feed roller 826 are formed so as to be normally and reversely rotated through the gear mechanism 860 which transmits the torque of a drive motor 851 described later. Even if the second platen roller 842 is coupled, the second platen roller 842 is formed so as not to be reversely rotated due to the one-way clutch 843 provided on the shaft of the second platen roller 842. The paper conveyance amount of the first platen roller 832 is set larger than that of the second platen roller 842 to an extent that the printing can appropriately be done. The pinch roller 827 is a driven roller.

The drive unit 850 includes the drive motor 851, the gear mechanism 860, and a cam mechanism 880. The gear mechanism 860 transmits the torque of the drive motor 851 to each unit.

The cam mechanism 880 includes a first gear 861 which transmits power from the drive motor 851 to other gears. The first gear 861 engages a second gear 862. The pinch roller cam 881 is attached to the second gear 862. The first gear 861 sequentially engages a third gear 863, a fourth gear 864, and a fifth gear 865. The thermal head cam 882 is attached to the fifth gear 865.

The second gear 862 and the fifth gear 865 are coupled to each other with different reduction ratios (2:1 in the tenth embodiment) from the drive motor 851. In order to detect the positions of the roller cam 881 and the thermal head cam 882, cam position sensors 883 and 884 are provided in the roller cam 881 and the thermal head cam 882, respectively. The position sensor may be provided in either the roller cam 881 or the thermal head cam 882 because the roller cam 881 and the thermal head cam 882 are directly connected with the gear mechanism 860.

The double-side printing thermal printer 810 having the above configuration is operated as follows. FIG. 28 is a flowchart showing a paper setting operation. The paper P is set from the right in FIG. 26 of the feed roller 826 (ST10). When the paper sensor 824 detects the front end of the paper P (ST11), the cam mechanism 880 is operated to rotate the roller cam 881 and the thermal head cam 882 by the drive motor 851, and the angles are adjusted in the roller cam 881 and the thermal head cam 882 (ST12). As shown by G1 in FIG. 31, the angle positions of the roller cam 881 and the thermal head cam 882 are set to 0°. Therefore, the pinch roller 827 and the first thermal head 831 are located at the positions where the paper conveyance path 822 is opened. Then, the feed mechanism 823 is operated to convey the paper P by the drive motor 851.

As shown by G2 in FIG. 31, when the paper start position finding sensor 825 detects the front end of the paper P conveyed by the feed mechanism 823 (ST13), the roller cam 881 is rotated to the angle position of 180° and the thermal head cam 882 is rotated to the angle position of 90° in the cam mechanism 880. At this point, the pinch roller 827 is located at the sandwiching position, and the first thermal head 831 is located at an opened position. At this time, the feed mechanism 823 reversely conveys the paper P. That is, although the first platen roller 832 and the feed roller 826 are reversely rotated, the second platen roller 842 is not reversely rotated because the second platen roller 842 is connected to the one-way clutch 843. Because the first thermal head 831 is located at the opened position, the paper P does not slide on the first thermal head 831, and the load applied on the drive motor 851 is decreased.

When the paper P is returned by a predetermined amount (ST14), the paper start position finding sensor 825 is turned off to stop the feed mechanism 823 while the printing start position of the paper P reaches the second thermal head 841 (ST15).

FIG. 29 is a flowchart showing a printing operation and a paper cutting operation. As described above, when the printing start position of the paper P reaches the second thermal head 841, the second printing unit 840 starts the printing (ST20). The feed mechanism 823 is normally rotated to convey the paper P. At this point, the roller cam 881 and the thermal head cam 882 are located at the angle positions shown by G3 in FIG. 31. The position G3 is similar to the position G2 in FIG. 31, the roller cam 881 is located at the angle position of 180°, and the thermal head cam 882 is located at the angle position of 90°. Accordingly, the cam mechanism 880 remains in the stopped state.

When the second printing unit 840 finishes the printing, the paper start position finding sensor 825 detects the paper P (ST21), and the paper P is conveyed by a predetermined amount (ST22). The predetermined amount is one in which the printing start position of the paper P passes by the first thermal head 831.

When the paper P is conveyed by the predetermined amount, or when the printing start position of the paper P passes by the first thermal head 831, the cam mechanism 880 is operated, and the roller cam 881 is rotated to the angle position of 360°, and the thermal head cam 882 is rotated to the angle position of 180° as shown by G4 in FIG. 31. In this case, the pinch roller 827 is located at the opened position, and the first thermal head 831 is located at the sandwiching position. At this point, the first printing unit 830 starts the printing (ST23).

When the first printing unit 830 finishes the printing, the roller cam 881 is rotated to the angle position of 180° and the thermal head cam 882 is rotated to the angle position of 90° as shown by G5 in FIG. 31. In this case, the pinch roller 827 is located at the sandwiching position, and the first thermal head 831 is located at the opened position. At this point, the paper P is cut with a cutter device 890 (ST24).

After the cutting, as shown by G6 in FIG. 31, the roller cam 881 is located at the angle position of 180° and the thermal head cam 882 is located at the angle position of 90°. The position G6 is similar to the position G5 in FIG. 31, and in this case the cam mechanism 880 remains in the stopped state. The feed mechanism 823 is reversely rotated to convey the paper P (ST25), the paper P is returned by the predetermined amount, and the paper start position finding sensor 825 is turned off (ST26). When the paper P is returned by the predetermined amount, the printing start position of the paper P reaches the second thermal head 841, and the feed mechanism 823 is stopped (ST27). The flow returns to ST20 to carry out the printing with the second printing unit 840 until the paper P is run out.

In the above operations, the cam mechanism 880 takes the same position at G2 and G3 in FIG. 31 and G5 and G6 in FIG. 31. However, the pinch roller 827 may be opened at G3 and G5 in FIG. 31. When the cam mechanism 880 is moved to the opened position, the positions of the cam mechanism 880 at the G2 and G3 in FIG. 31 and G5 and G6 in FIG. 31 are changed.

FIG. 30 is a flowchart showing an operation when the paper is run out. During the printing or after the printing (ST30), when the paper sensor 824 does not detect the paper (ST31), the printing is terminated (ST32). At this point, as shown by G7 in FIG. 31, the roller cam 881 is rotated to the angle position of 540° and the thermal head cam 882 is rotated to the angle position of 270°. In this case, the pinch roller 827 is located at the sandwiching position, and the first thermal head 831 is located at the opened position. The feed mechanism 823 is reversely rotated, and all the pieces of paper P are returned to a paper conveyance path entrance. When all the pieces of paper P are returned, the paper is manually removed (ST33).

Then, the paper setting operation shown in FIG. 28 is performed. In this case, in the cam mechanism 880, as shown by G8 in FIG. 31, the roller cam 881 is rotated to the angle position of 720° and the thermal head cam 882 is rotated to the angle position of 360°. At this point, the cams of the cam mechanism 880 are located at the same positions as G1 in FIG. 31 respectively, and the cams are located at the positions so as to open the pinch roller 827 and the first thermal head 831.

As described above, according to the double-side printing thermal printer 810 of the tenth embodiment, the sandwiching state is opened between the first thermal head 831 and the first platen roller 832 until the front end of the paper P reaches the first printing unit 830, and the paper P is sandwiched between the first thermal head 831 and the first platen roller 832, which allows the slide to be suppressed to the minimum between the first thermal head 831 and the paper P. In the normal rotation, the pinch roller 827 is positioned so as to be moved to the position where the pinch roller 827 is opened from the feed roller 826. Therefore, the load on the paper conveyance can be reduced.

When the motor is used for the paper conveyance, the thermal printer can be miniaturized by decreasing the power necessary for the paper conveyance. The consumable components such as the thermal head do not always sandwich the paper, so that the breakage by the paper edge or wear can be suppressed to the minimum. Therefore, the compact, long-life double-side printing thermal printer is obtained.

Because the first platen roller 832 is larger than the second platen roller 842 in the paper conveyance amount, the proper tension is applied to the paper P when the paper P is normally conveyed, so that the thermal recording paper can smoothly be conveyed without being bent. When the paper P is reversely conveyed, because the driving force is not applied to the second platen roller 842 during the reversal rotation, the paper P is conveyed by the first platen roller 832. When the paper P is reversely conveyed, a sandwiching pressure of the pinch roller 827 is adjusted to a lower level in the sandwiching state such that the paper conveyance amount becomes the paper conveyance amount of the first platen roller 832.

As described above, according to the double-side printing thermal printer 810 of the tenth embodiment, the first thermal head 831 and the pinch roller 827 are opened if needed, and the breakage and wear can be reduced. Further, the load can be decreased during the paper conveyance to miniaturize the drive motor 851. Accordingly, the long life and the high reliability can be realized.

The invention is not limited to the above embodiments. For example, although the second thermal head is not brought into contact and separated in the tenth embodiment, the second thermal head may be brought into contact and separated if needed. Although the cam angle in each state and the gear ratio of the cam mechanism are described above, various changes thereof may be made as long as the above operations are performed. The thermal head is brought into contact with and separated from the pinch roller with the cam mechanism in the tenth embodiment. Alternatively, a crank mechanism or the like may be used. Obviously, the constituents of the invention including the thermal head, the platen roller, the platen roller gear, the biasing means, and the power transmission mechanism can appropriately be changed. The thermal printer of the invention can also be used to carry out the printing onto the single-sided thermal recording paper having the heat-sensitive layer only on one surface side.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A printing apparatus comprising:

a thermal recording paper conveyance mechanism which conveys thermal recording paper along a paper conveyance path;

a first thermal head which is provided along the paper conveyance path, and is arranged to face a first surface side of the paper conveyance path;

a first platen roller which is arranged to face the first thermal head across the paper conveyance path;

a first spring that presses the first thermal head toward the first platen roller with a first force;

a second thermal head which is provided along the paper conveyance path and on a supply side of the thermal recording paper with respect to the first thermal head, and is arranged to face a second surface side of the paper conveyance path;

a second platen roller which is arranged to face the second thermal head across the paper conveyance path;

a second spring that presses the second thermal head toward the second platen roller with a second force;

a drive mechanism that includes a selective torque transmission mechanism that engages a gear mechanism to transmit torque when the first platen roller is rotated in a conveyance direction of the thermal recording paper, and disconnect the torque when the first platen roller is rotated in a reverse conveyance direction of the thermal recording paper, wherein the first platen roller differs from the second platen roller in a feed speed of the thermal recording paper and the second platen roller is exclusively driven by the thermal recording paper when the selective torque transmission mechanism engages the gear mechanism to transmit the torque when the first platen roller is rotated in the conveyance direction of the thermal recording paper.

2. The printing apparatus according to claim 1, wherein the selective torque transmission mechanism engages the gear mechanism to transmit the torque when the second platen roller is rotated in the reverse conveyance direction of the thermal recording paper, and disconnect the torque when the second platen roller is rotated in the conveyance direction of the thermal recording paper.

* * * * *